US009249644B1

(12) United States Patent
Stone

(10) Patent No.: US 9,249,644 B1
(45) Date of Patent: Feb. 2, 2016

(54) INTERNAL BIDIRECTIONAL TUBING PLUG

(71) Applicant: NEW PRODUCT ENGINEERING, INC., Tulsa, OK (US)

(72) Inventor: William Bundy Stone, Tulsa, OK (US)

(73) Assignee: New Product Engineering, Inc., Tulsa, OK (US)

( * ) Notice: Subject to any disclaimer, the term of this patent is extended or adjusted under 35 U.S.C. 154(b) by 408 days.

(21) Appl. No.: 13/889,671

(22) Filed: May 8, 2013

Related U.S. Application Data

(62) Division of application No. 12/806,353, filed on Aug. 11, 2010, now Pat. No. 8,459,344.

(60) Provisional application No. 61/276,097, filed on Sep. 8, 2009.

(51) Int. Cl.
*E21B 33/134* (2006.01)
*E21B 33/12* (2006.01)

(52) U.S. Cl.
CPC ..... *E21B 33/12* (2013.01); *E21B 33/134* (2013.01)

(58) Field of Classification Search
CPC ..... E21B 23/04; E21B 23/08; E21B 33/1208; E21B 33/1293; E21B 33/1295; E21B 33/134; E21B 34/063
See application file for complete search history.

(56) References Cited

U.S. PATENT DOCUMENTS

| | | | | | |
|---|---|---|---|---|---|
| 1,092,540 | A | | 4/1914 | Robinson | |
| 1,263,933 | A | | 4/1918 | Robinson | |
| 1,388,564 | A | | 8/1921 | Haynes | |
| 4,188,999 | A | * | 2/1980 | Amancharla | E21B 33/12 166/133 |
| 4,220,206 | A | | 9/1980 | Van Winkle | |
| 4,260,021 | A | * | 4/1981 | Mott | E21B 23/006 166/237 |
| 4,784,226 | A | | 11/1988 | Wyatt | |
| 5,511,617 | A | * | 4/1996 | Snider | E21B 34/14 166/185 |
| 2004/0108142 | A1 | * | 6/2004 | Vail, III | E21B 7/065 175/171 |
| 2005/0034860 | A1 | | 2/2005 | Lauritzen | |

FOREIGN PATENT DOCUMENTS

| | | | | |
|---|---|---|---|---|
| WO | WO2012/112053 | * | 8/2012 | E21B 33/12 |

* cited by examiner

*Primary Examiner* — Cathleen Hutchins
(74) *Attorney, Agent, or Firm* — Molly D. McKay

(57) ABSTRACT

A process of manufacturing a well closure apparatus and using it downhole by releasing components contained within the apparatus. The well closure apparatus is an internal bidirectional tubing plug that is adapted for insertion into a tubing string for sealing the tubing string internally while running the tubing into a fluid filled well. The tubing plug is comprised of a body having an inner surface with a recess or passage extending through the body from one end to the other. The recess holds petals and a keystone petal that are held within the recess by a cork and the cork is held in place by a nut. At depth, the tubing is filled with well fluid, the tubing plug is released at a predetermined hydraulic pressure, and the pieces of the releasing components are pumped to the bottom of the well or are circulated out of the well.

4 Claims, 27 Drawing Sheets

DETAIL A

Detail A

Detail A

Detail A

Detail A

Detail A

Detail A

Detail B

Detail A

Detail A

Detail A

INTERNAL BIDIRECTIONAL TUBING PLUG

CROSS-REFERENCE TO RELATED APPLICATIONS

The present application is a divisional application claiming priority to U.S. patent application Ser. No. 12/806,353 for Internal Bidirectional Tubing Plug filed on Aug. 11, 2010, which in turn claims priority to U.S. Provisional Patent Application Ser. No. 61/276,097 for Bi-directional Internal Tubing Plug filed on Sep. 8, 2009.

BACKGROUND OF THE INVENTION

1. Field of the Invention

This invention relates to closure means for well conduits. More particularly, it relates to temporary plugs that are removable without mechanical intervention from the surface above the well. More specifically this invention relates to running new or used tubing, known as a work string, into a well filled with drilling mud or water, well fluids, behind a drill bit and drill collars, a packer or open ended as fast and as safely as possible and at the same time directing the displaced well fluid to a pit or tank while preventing the well fluid from entering the tubing, through a bit, a packer, or open ended.

It is also desirable to prevent displaced well fluids from being displaced out the surface open end of the tubing into the atmosphere. The displaced well fluids will take the path of least resistance to the atmosphere. If the displaced well fluids are allowed to enter the tubing well fluids will "spray" out the surface open end of the tubing coating the rig, rig crew, stripping rubber, blow out preventers, wellhead, and ground and generally impair safe working conditions. It is also possible to contaminate the ground or create a fire or chemical hazard as some well fluids contain hazardous chemicals and compounds.

In general practice the tubing is lowered very slowly into a well to allow the well fluids to drain from the tubing/annulus casing valve, and slow enough to prevent well fluids from spraying out the open end of the tubing. This method of running a tubing string very slowly is costly to well operators due to the additional rig time. It is desirable to run the tubing as fast as possible, in a safe manner, to reduce the well operators cost.

One problem is controlling the well fluids from being displaced from the tubing/casing annulus while the tubing is being lowered into the well. This is accomplished by using a "stripping rubber", as known in the art. The stripping rubber effectively seals the tubing/casing annulus diverting all displaced well fluids up the tubing and out the casing valve at the same time. The casing valve is generally placed on a kill-choke/spool below the blow out preventers. The casing valve is generally opened to a flow line ending at a flow back tank, frac tank, and or an earth pit. The flow lines that are directed to a flow back tank generally have sufficient restriction in them to not be able handle all of the displaced well fluids through the casing valve which causes more of the displaced well fluids to be directed into the tubing and out the end of it at the surface.

The second problem is that if the well operator chooses to run a stripping rubber and a drill pipe float valve above the bit, essentially a check valve, all displaced well fluids will be diverted to the casing valve and to a tank or pit. But using a drill pipe float valve causes another problem.

The third problem is that when using a drill pipe float valve and stripping rubber circulation of the well fluid may only occur down the tubing and up the tubing/casing annulus.

There are situations where this setup may limit the control of the well by not allowing well fluids to be circulated down the tubing/casing annulus and up the tubing.

A fourth problem is that when using a drill pipe float valve with a stripping rubber and drilling out any obstructions in a well such as DV tools (known as stage cementing tools in the art), DV rubbers, primary cementing rubbers and any excess cement left in the well, a high circulation rate is necessary to carry all drilled and washed debris up the tubing/casing annulus through the casing valve, flow line, and to a wash tank. If the casing valve or flow line become plugged circulation up the tubing/casing will be lost. If circulation is lost the annulus debris in the annulus will fall down hole around the tubing "sticking" the tubing. To remove the tubing a "fishing" job is required that is very expensive and for this reason this set up is not used by prudent operators.

A fifth problem is created when using a wire line (also known as "slick line" in the art) retrievable "blanking plug" as known in the art. One way to prevent well fluids from entering the tubing is to run a wire line retrievable blanking plug, in a tubing nipple, at or above the bottom end of the tubing. A retrievable blanking plug seals off fluid flow in both directions of the tubing. With a blanking plug in place while running the tubing, in conjunction with a stripping rubber, all displaced fluids are diverted through a casing valve. While picking up a new or used work string and running it into the well, mill scale, rust, dirt, tubing dope, and all manner of debris fall down the tubing and land on top of the blanking plug.

Once the tubing is at depth the tubing is filled with fluid to equalize differential pressure across the retrievable blanking plug so that it may be removed from the tubing. This is accomplished by running a wireline blanking plug retrieval tool and equalizing prong (in some cases) to release the retrievable blanking plugs latching members from a tubing sub known as a nipple. However, in most cases the tubing debris, a mentioned above, have fallen down and covered the retrievable blanking plug such that the retrievable tool and equalizing prong cannot engage the blanking plug to equalize, release, and pull it from the tubing to the surface. At this time the debris must be washed off the retrievable blanking plug before it is pulled from the tubing. This may be accomplished by using coiled tubing and or snubbing operations or other methods, as known in the art which incur additional cost and time. Sometimes the fluid laden tubing must be pulled from the well. Experience has shown that using a retrievable blanking plug is not a cost effective way to prevent well fluids from entering a tubing string.

A sixth problem occurs when running a "pump-out-plug" as known in the art. The pumped-out portion of the pump-out-plug has an outside diameter greater than the internal diameter of the tubing and therefore it may not be circulated out of the well up the tubing. Further, the pumped-out portion of the pump-out-plugs outside diameter is generally of a dimension that prevents is from being circulated from the well up the tubing/casing annulus. Additionally the pumped-out portion of a pump-out-plug is generally made from a metal, generally aluminum, which will fall on top of any cased-hole tools below the pump-out-plug and prevent them from being pulled from the well at a later date as the pumped-out portion may become wedged between the casing internal surface and the outer surface of the cased-hole tools (known as retrievable packers, retrievable bridge plugs, and others) as know in the art. Therefore, in general, pump-out-plugs are only run in a well at the bottom end of a tubing string, sometimes below a retrievable packer, and the pumped-out portion of the pump-out-plug falls into the rat hole at the bottom of the well. Pump-out-plugs are not compatible and with a drill bit.

A seventh problem occurs when running a "rupture disk" as known in the art. A rupture disk is run above the bit and drill collars in the tubing in a tubing nipple or a J-J (the small internal area in a tubing collar between the two pin ends of tubing) to prevent well fluid from entering the tubing when it is run into a well full of well fluid. When it is time to establish circulation the tubing is filled with fluid and pressure applied on top of the rupture disk rupturing it and establishing circulation in the well. The debris left in the J-J or tubing nipple of the rupture disk are protrusions into the internal diameter of the tubing string. These protrusions may hang debris circulated up the tubing and plug it off causing the operator to pull the work string. Many times surface intervention may be required to pierce the rupture disk to facilitate it to rupture. Experience has shown that the use of a rupture disk is fraught with potential problems and unnecessary economic expense.

An eight problem occurs when lowering tubing into a well containing drilling mud with lost circulation material (cotton seed hulls, walnut chunks, cellophane particles, and others) in it. Experience has shown that the lost circulation material, when entering the bit, may plug it off, or the tubing above the bit. This situation reminds us that in this situation it is generally a good idea to run some type of tubing plugging apparatus.

Therefore, the primary object of this invention is to prevent well fluids from entering the tubing as it is lowered into a well full of fluid.

A second object of this invention is to remove the plugging apparatus with well fluids leaving no debris in the tubing.

A third object of this invention is to remove the plugging apparatus without surface intervention.

A fourth object of this invention is to be able to establish circulation at any time allowing the operator full control of the well.

A fifth object of this invention is to allow the well operator, when pumping out the plugging apparatus, to monitor the tubing pressure at the surface, to identify when the internal bidirectional tubing plug has released, by observing a pressure build up and fall off, and then establish that the well is circulating.

A sixth object of this invention is to leave the internal diameter of the tubing constant when the plugging apparatus is removed.

A seventh object of this invention is to blank off the tubing with very small parts that may be circulated through a workover bit, up the tubing/casing annulus, or through the workover bit up the tubing to the surface.

An eight object of this invention is to manufacture the small parts of this plugging apparatus of a material recognized as biodegradable.

A ninth object of this invention is to manufacture the internal parts of this plugging apparatus of a material that is sufficient for the pressures and temperatures encountered in most well conditions.

A tenth object of this invention is to manufacture the parts of this plugging apparatus from a material that is easily drillable.

2. Description of the Related Art

U.S. Pat. No. 2,153,812, Newton, 1939, teaches us that wireline plugs run in casing or tubing require surface intervention to run or retrieve a check valve or blanking plug, and most generally a prong or rod to equalize and release the in place device then pull it to the surface.

U.S. Pat. No. 2,856,003, J. V. Fredd, 1958, teaches us that wireline plugs run in casing or tubing require surface intervention to run or retrieve a check valve or blanking plug, and most generally a prong or rod to equalize and release the in place device then pull it to the surface a different way.

U.S. Pat. No. 6,427,773 B1, Albers, 2002, and the U.S. Documents Cited dated through September 1998, refer to wireline retrievable devices require surface intervention.

Any discussion of the prior art throughout the specification should in no way be considered as a discussion that such prior art is known or forms part of common general knowledge in the field.

SUMMARY OF THE INVENTION

The present invention provides a method and apparatus for establishing a temporary internal bidirectional tubing plug within well conduits that can be removed upon demand to permit fluid flow past the plugged point within a short period of time. It is anticipated that the plugging apparatus and methods disclosed herein will be applicable in any size conduit. The dimensions of the plug will be dependent upon the area to be plugged and the service conditions into which it will be placed. Removal of the plug is accomplished without mechanical intervention from the well's surface. Furthermore, the resulting debris or "fall out" from the bidirectional internal plug comprises sufficiently small members that are easily transported by the fluids of the well without blocking or fouling other aspects and equipment of the well. These benefits, as well as others that will become apparent, to someone versed in the art, from the disclosure made herein, provide time, and cost savings to a well operator.

In one or more embodiments described herein, the internal bidirectional tubing plug consists of a number of small petals and a cork or balls that transfer the forces applied to them by the differential pressure across the plug into the body of the plug that is screwed into the tubing string.

During the initial completion of a well, the tubing, generally with a drill bit on the bottom of the tubing, is lowered into a fluid filled casing string. As the tubing is lowered the tubing displaces its volume out of the well. The displaced fluid may be water, drilling mud; oil based drilling mud, drilling mud with lost circulation material in it, drilling mud with harmful chemicals in it, or a combination of the above described fluids. As the tubing is lowered into the well the well fluid is displaced both out of the annulus of the tubing/casing and up the inside of the tubing string. The fluid from the tubing/casing annulus may be directed to a pit or tank by the use of a stripping rubber. When using a stripping rubber some of the displaced casing fluid is displaced up the tubing string into the atmosphere spraying fluid on the rig, rig crew, stripping rubber, rig blow-out-preventers, and well head filling the well head cellar with casing fluid. It is desirable to temporarily plug off the tubing string above the bit, and to displace all of the displaced well fluid to a pit or tank using a stripping rubber. When displacing fluids from a well casing containing drilling mud with lost circulation material in it many times this type of fluid will bridge off and plug the interior of the tubing string causing lost time and either significant expense and rig downtime.

Regarding oil and gas wells, there are many types of temporary plugs that are used for different applications. Temporary plugs that may be removed from a well intact are referred to as "retrievable" plugs. Removal, however, requires mechanical intervention from the surface of the well. Common intervention techniques include re-entry into the well with wireline, coiled tubing, or a smaller tubing string.

After a wire line retrievable blanking plug has been set in a tubing sub at the surface, screwed into the tubing, and run in the well and it subsequently becomes necessary to remove the blanking plug to establish well circulation, any retrievable tools that have been designed to remove the blanking plug must be run into the tubing to latch onto the blanking plug prior to removing it from the tubing. The installation and effort of installing the wire line and the pulling of tools and removal of the plug to reestablish flow within a downhole conduit often entails significant cost and rig downtime. It is, therefore, desirable to develop an internal bidirectional tubing plug which may be readily removed or destroyed without either significant expense or rig downtime.

Some temporary non-retrievable tubing plugs are in the form of frangible rupture disks or sand plugs that leave debris on the inside diameter of the tubing leaving a restriction to the inside diameter of the tubing that may potentially causing operational problems in the future.

The present invention is a internal bidirectional tubing plug that is run in place at any position in the tubing string, generally above a bit, or above the drill collars above the bit, preventing fluid entry into the tubing being run into the well. When using this invention in conjunction with a stripping rubber all of the displaced fluid in the well bore is displaced to a pit or tank, through a casing valve, eliminating fluid from being sprayed on the rig, and rig crew, or contamination the environment which allows more control of the well and allows the tubing to be run into the well at a faster rate. After the tubing string reaches its desired depth the tubing is filled with well fluid to equalize the hydrostatic pressure differential across the internal bidirectional tubing plug. Applying hydraulic pressure on top of the equalized internal bidirectional tubing plug acts on the cork of the internal bidirectional tubing plug releasing it which is displaced by tubing fluid, that then allows the tubing fluid to displace the small petals of the present invention out the end of the tubing or bit establishing communication between the tubing and tubing/casing annulus. The small petals and cork fall to the bottom of the well or are circulated to the surface.

BRIEF DESCRIPTION OF THE DRAWINGS

FIG. 4 Detail A is close up of the nut, cork, keystone petal and upper piston of the internal bidirectional tubing plug of FIG. 4.

FIG. 9 Detail A is a rotated view of the petals of the internal bidirectional tubing plug.

FIG. 10 Detail A is a rotated view of the top petal of the internal bidirectional tubing plug.

FIG. 11 Detail A is a rotated view of the bottom petal of the internal bidirectional tubing plug.

FIG. 12 Detail A is a rotated view of the keystone petal of the internal bidirectional tubing plug.

FIG. 13 Detail A is a front cross sectional view of the cork, o-ring and nut of the internal bidirectional tubing plug.

FIG. 15 Detail A is an isometric view of the upper piston of the internal bidirectional tubing plug.

FIG. 15 Detail B is an isometric view of the lower piston of the internal bidirectional tubing plug.

FIG. 16 Detail A is a rotated view of the nut of the internal bidirectional tubing plug.

FIG. 20 Detail A is a front cross sectional view of the assembly device, shown with a nut in place, a body positioned over the assembly device, and all petals in place, less the keystone petal of the internal bidirectional tubing plug.

FIG. 21 Detail A is a front cross section view of the assembly device, shown with a nut in place, a body positioned over the assembly device, petals in place, and the keystone petal pre positioned in place of the internal bidirectional tubing plug.

FIG. 24 Detail A is an isometric view of the one-half piston of the internal bidirectional tubing plug.

FIG. 24 Detail B is a rotated view of the one-quarter piston of the internal bidirectional tubing plug.

FIG. 24 Detail C is an isometric view of the lower piston of the internal bidirectional tubing plug.

FIG. 25 Detail A is a front cross sectional view of FIG. 24 of the internal bidirectional tubing plug.

FIG. 27 Detail B is an isometric view of a lower piston of an embodiment of the internal Bidirectional Tubing as shown in FIG. 25.

DETAILED DESCRIPTION OF THE PREFERRED EMBODIMENT

Figure 1:
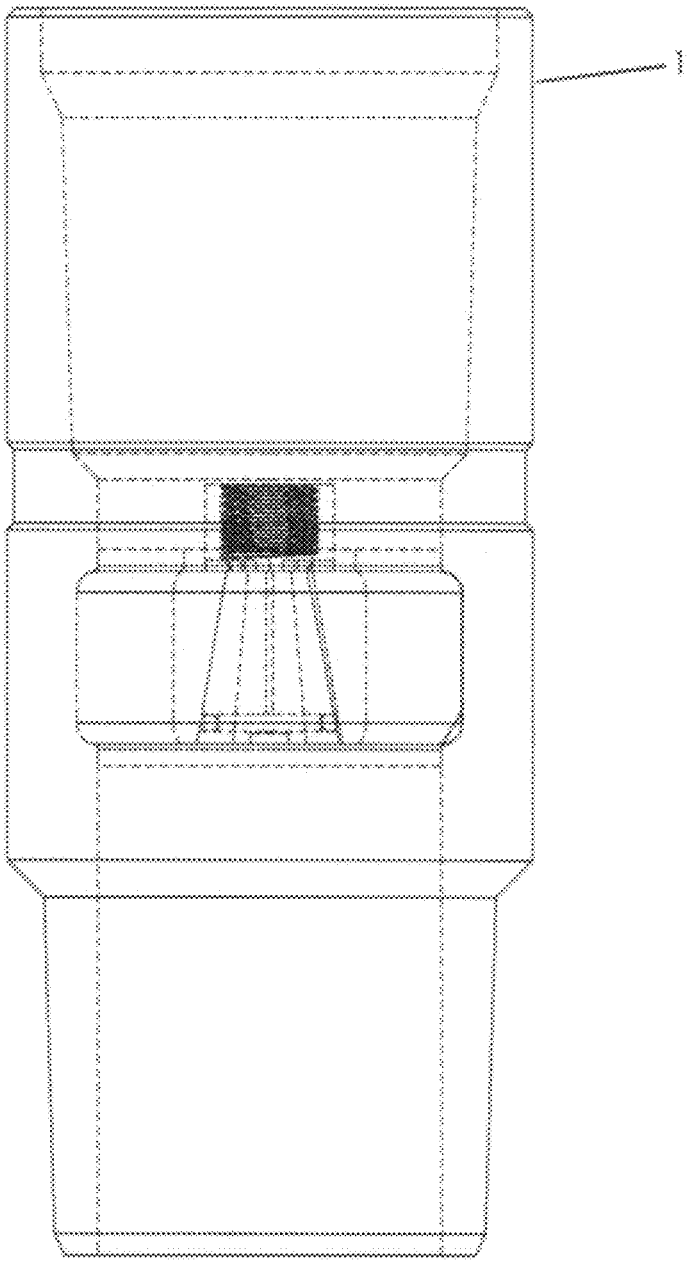
FIG. 1 is a front view with hidden lines shown of the internal bidirectional tubing plug.

Referring now to FIG. 1, this is a front view with hidden lines shown of the internal bidirectional tubing plug 1. The purpose and function of the internal bidirectional tubing plug is to prevent well fluids from passing this plug in a well conduit, in either direction, in a well until it is activated and pumped apart and the pieces are pumped down or up a tubing string (not shown), or down or up a casing/tubing annulus (not shown).

Figure 2:
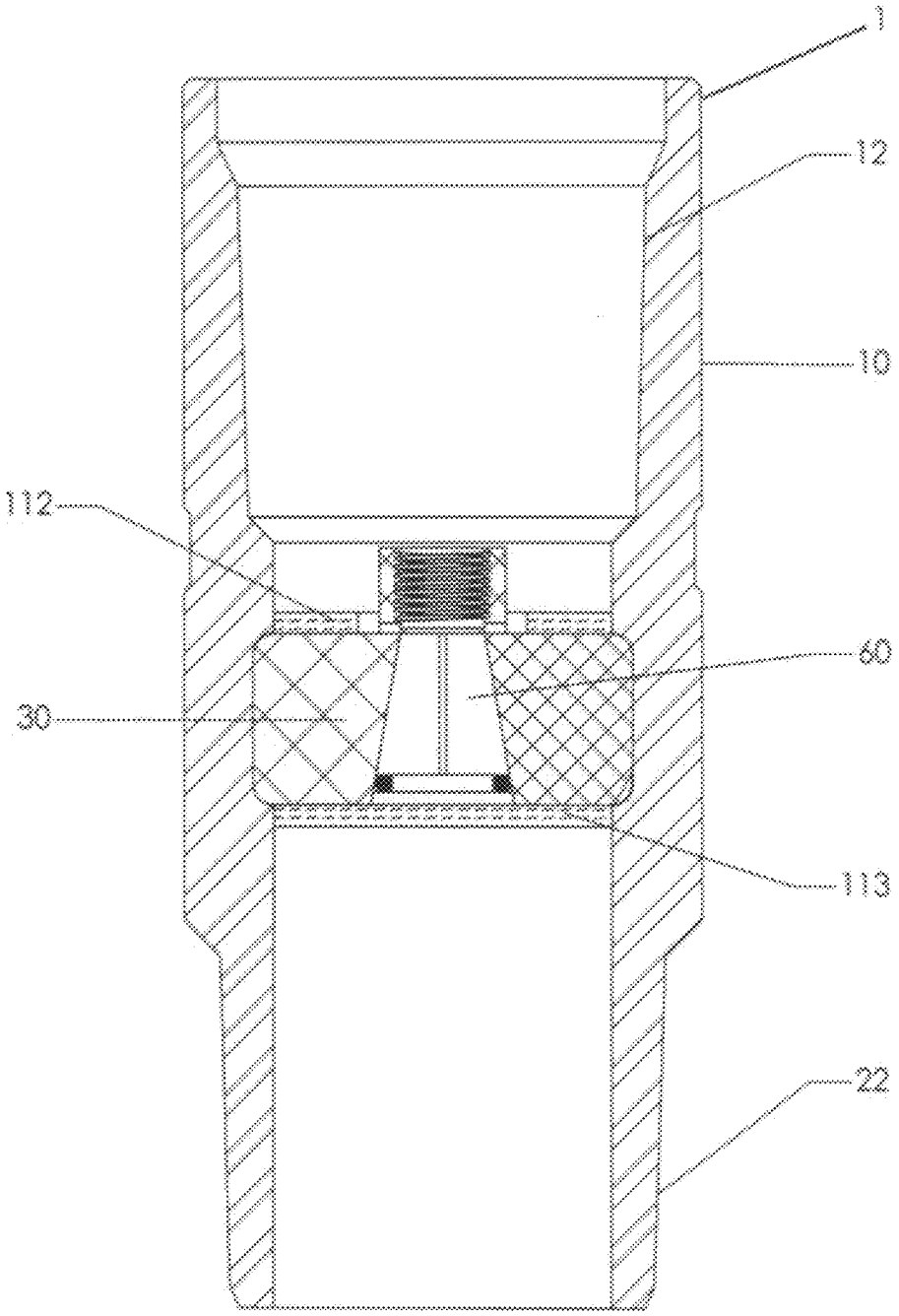
FIG. 2 is a front cross section view of FIG. 1 except the cork of the internal bidirectional tubing plug.

Referring now to FIG. 2, FIG. 2 is a front cross sectional view of the body 10 (see FIG. 7), cork assembly 60 (see FIG. 11), petal assembly 30 (see FIG. 8), upper piston 112 (see FIG. 13A), and lower piston 113 (see FIG. 13B). The pin Connection 22 of the body 10 (see FIG. 7), screws into a tubing string (not shown) which generally is above the bit (not shown) and drill collars (not shown), and a pin connection (not shown) of the tubing string (not shown) screws into the box connection 12 of the internal bidirectional tubing plug 1 (see FIG. 1). The internal bidirectional tubing plug 1 (see FIG. 1) is now lowered into the fluid filled well (not shown), and the internal bidirectional tubing plug 1 (see FIG. 1) prevents well fluid (not shown) from entering the tubing. The tubing's outside volume is displaced up the tubing/casing annulus (not shown) against a stripping rubber (not shown) and well fluids (not shown) are forced out of the well (not shown) through a casing valve (not shown) to a pit (not shown).

Figure 3:
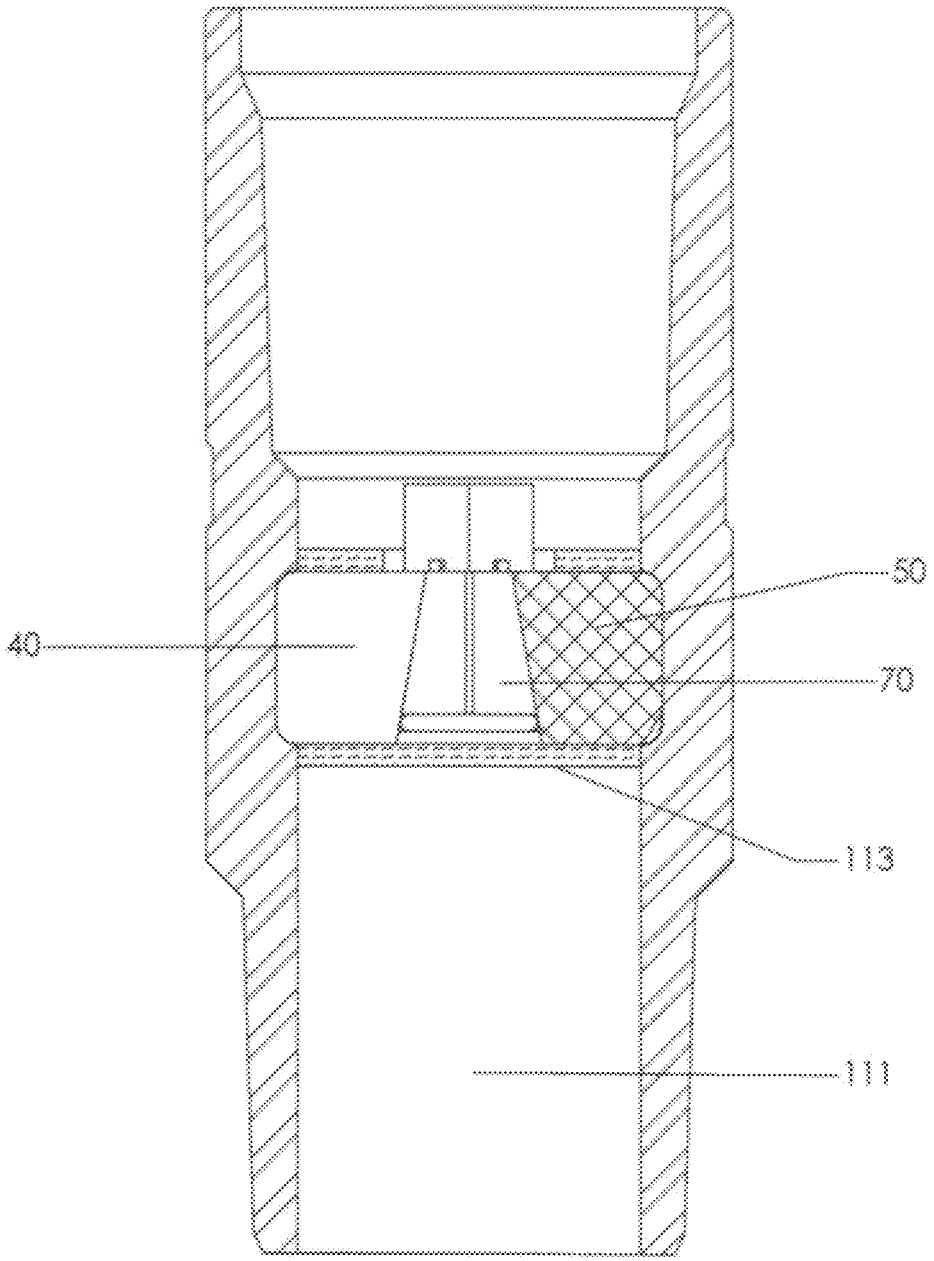
FIG. 3 is a front cross section view of FIG. 1, except the nut, cork, and O-ring of the internal bidirectional tubing plug.
Figure 7:
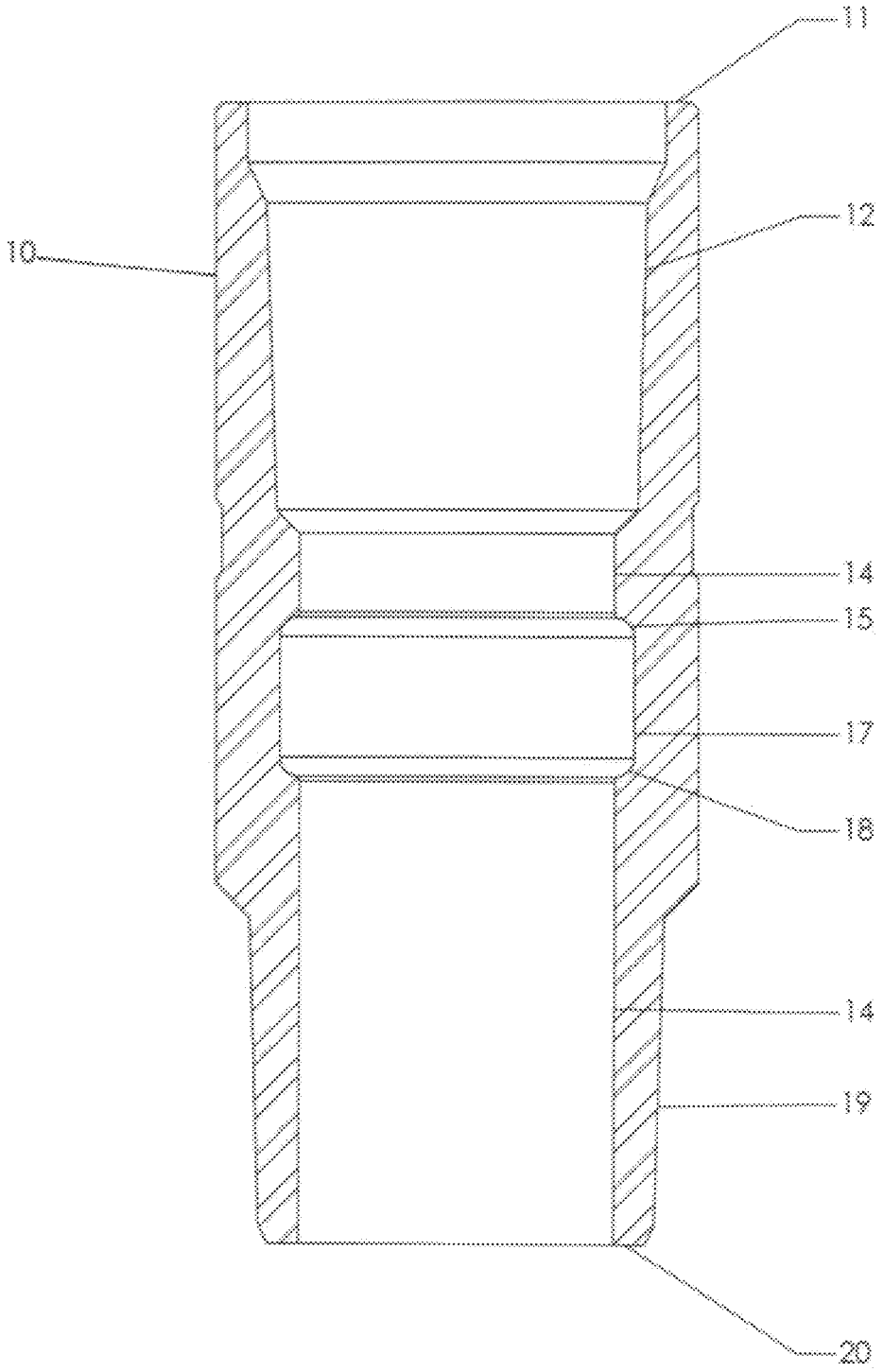
FIG. 7 is a front cross section view of the body, of the internal bidirectional tubing plug.

Referring now to FIG. 3, FIG. 3 shows that as the internal bidirectional tubing plug 1 (see FIG. 1) is lowered into the fluid filled well (not shown), a hydrostatic pressure (not shown), is developed in area 111, generating a force (not shown) which acts against the lower piston 113 (see FIG. 13 Detail B), which acts against the bottom 47, of the petals 40 (see FIG. 9), the bottom 57 of the keystone petal 59 (see FIG. 12), the bottom 127 of the top petal 120 (see FIG. 10), the bottom 137 of the bottom petal 137 (see FIG. 11), and the bottom 77 of the cork 70 (see FIG. 14) which transfers this force into the upper lip 15 of the body 10 (see FIG. 7). Additionally the force generated (not shown) on the bottom 77 of the cork 70 (see FIG. 14), due to the tapered side 75 of the cork 70 (see FIG. 14), directs the vertical and horizontal component of the generated force (not shown) through the petals 40 (see FIG. 9), top petal 120 (see FIG. 10), bottom petal 130 (see FIG. 11), keystone petal 50 (see FIG. 12), outward and upward respectively (not shown), into the recess 17 of the body 10, and the upper lip 15 of the body 10 (see FIG. 7).

Figure 4:
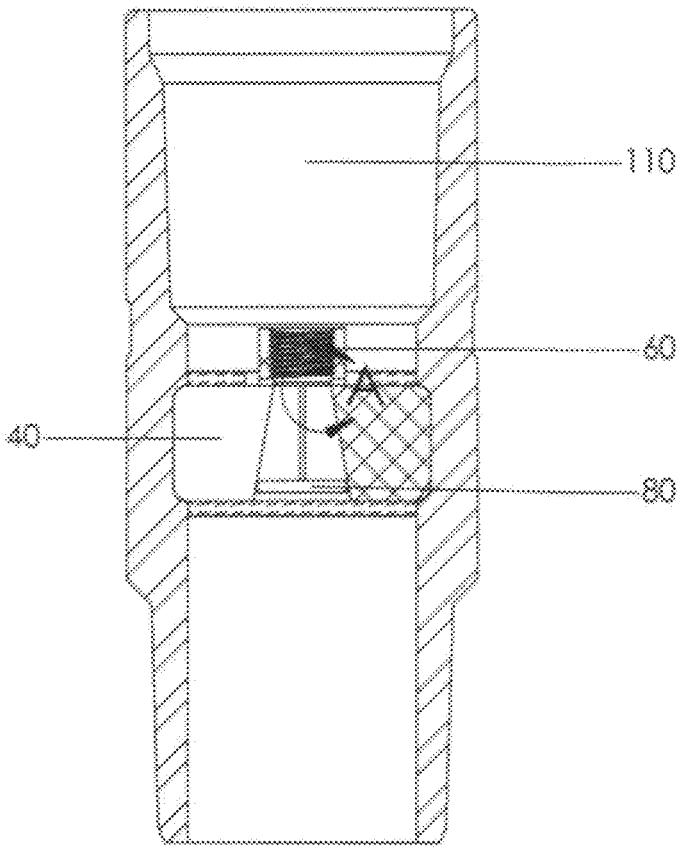
FIG. 4 is a front cross section view of the body, nut, keystone petal, and upper and lower piston of the internal bidirectional tubing plug.
Figure 4:
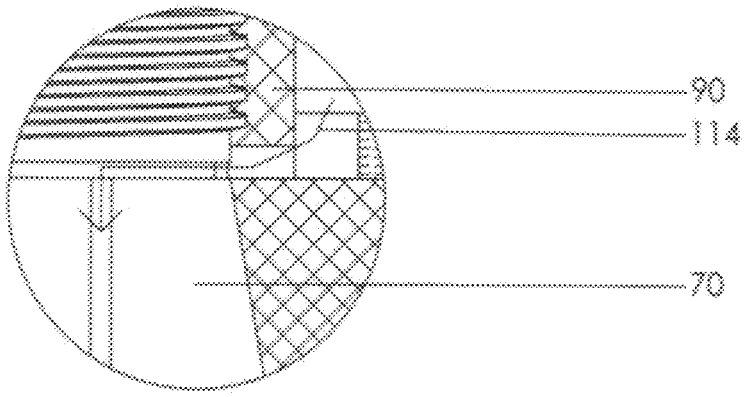

Referring now to FIG. 4, FIG. 4 is step one of the release method. Once the internal bidirectional tubing plug 1 (see FIG. 1) reaches its working depth (not shown), well fluids (not shown) are pumped into the tubing string (not shown) to fill it, which equalized the hydrostatic pressure (not shown) across the internal bidirectional tubing plug 1 (see FIG. 1). To release the internal bidirectional tubing plug 1 (see FIG. 1) hydraulic pressure is applied in area 110 of internal bidirectional tubing plug 1 (see FIG. 1). As seen in Detail A of FIG. 4, applied hydraulic pressure (not shown) acts through fluid path 114, that exerts hydraulic pressure on an area (not shown) as defined by outside diameter of the O-ring 80 (see FIG. 15), that exerts a downward force (not shown), opposing an upward force defined by the area of the recess 73 of the cork 70 (see FIG. 14) outside diameter, and the mechanical properties (not shown) of the material of the cork 70, held by the nut 90. When the downward forces (not shown) exceed the upward forces (not shown) the cork fails in tension (not shown) at the recess 73 allowing the cork 70 to move downward (not shown) after it fails.

Figure 5:
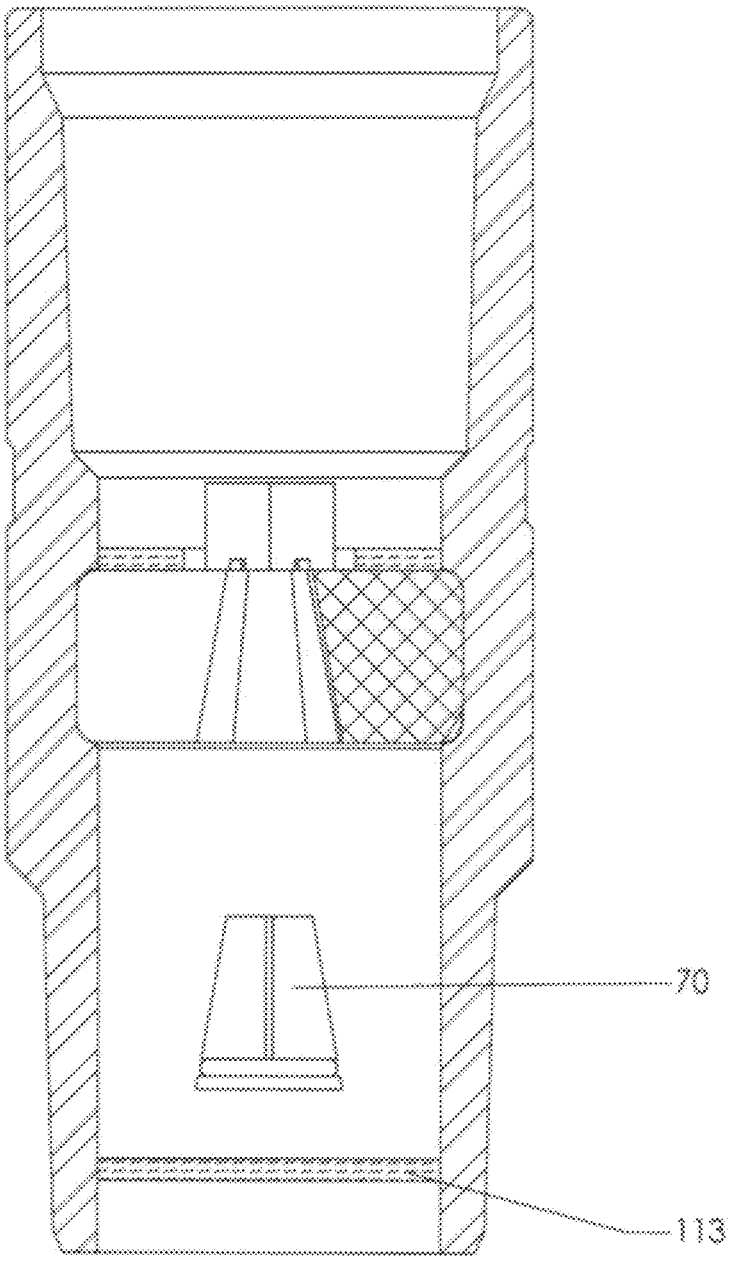
FIG. 5 is a front cross section view of the body, upper piston, keystone petal, and displaced lower piston showing a displaced cork with o-ring, and stationary nut of the internal bidirectional tubing plug.

Referring now to FIG. 5. FIG. 5 is step two of the release method. Once the cork 70 has parted, well fluids (not shown) from above the internal bidirectional tubing plug 1 (see FIG. 1) displace the cork 70 and lower piston 113 downward and away from the internal bidirectional tubing plug 1 (see FIG. 1).

Figure 6:
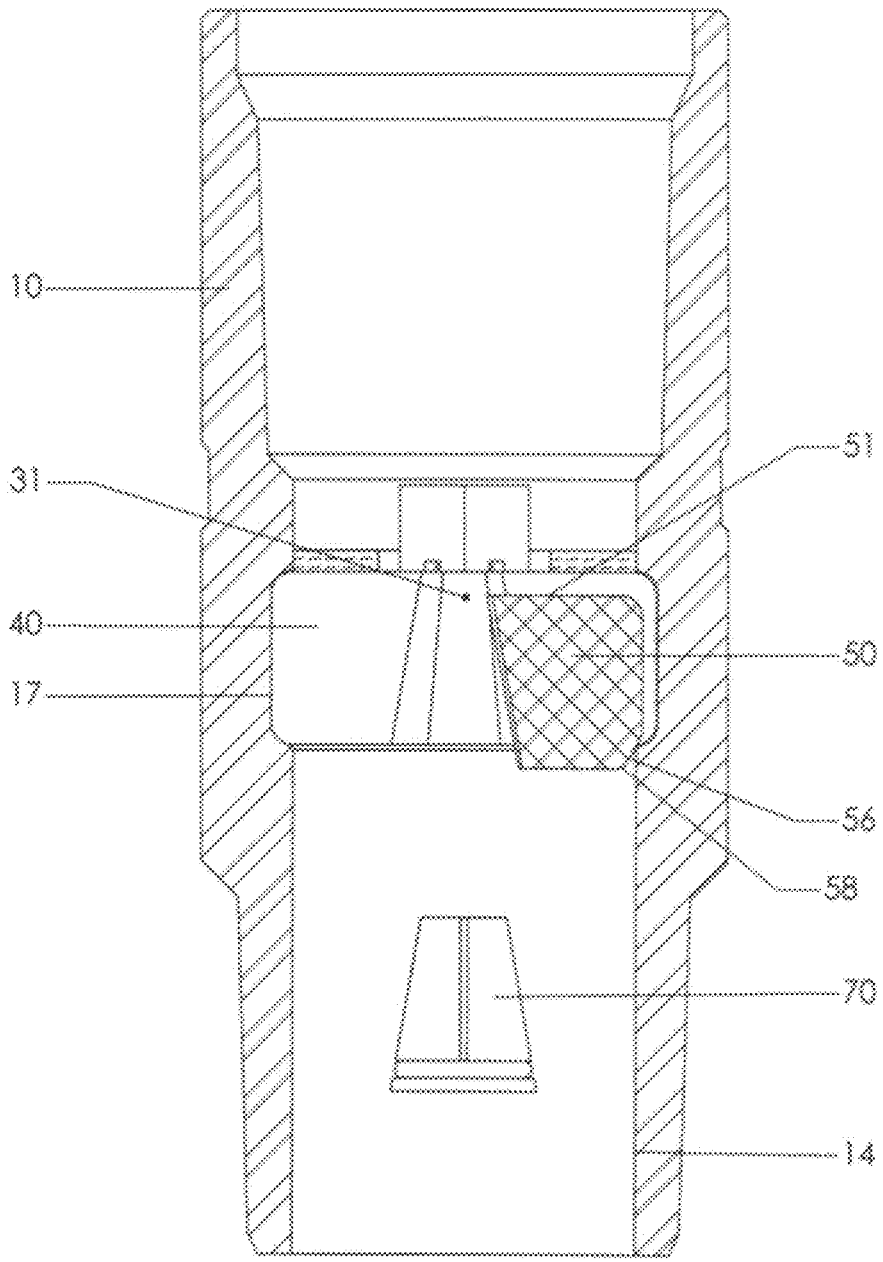
FIG. 6 is a front cross section view of the body, all petals, upper piston, and partially displaced keystone petal, showing a displaced cork and o-ring not in cross section of the internal bidirectional tubing plug.

Referring now to FIG. 6, FIG. 6 is step three of the release method. After the cork 70 has been displaced from the petal assembly 30 (see FIG. 8) fluid flow through the hole 31 in the petal assembly 30 (see FIG. 8) generates a differential pressure (not shown) across the petal assembly 30 (see FIG. 8), this differential pressure (not shown) acts on the upper surface 51 of the keystone 50 generating a downward force (not shown) that forces the keystone 50 outward, out of the body 10 recess 17 (see FIG. 7), due to its bevel 56 and out of the petal assembly 30 (see FIG. 8). Note that the inner lip 58 of the keystone petal 50 has an inside diameter (not shown) that is less that the inside diameter 14 of the body 10 which allows the bevel 56 of the keystone petal to ride against the inside diameter 14 of the body 10 forcing the keystone petal 50 downward and inward out of the petal assembly 30 (see FIG. 8) leaving a space (not shown). The resulting space (not shown) and fluid flow (not shown) through remainder of the petal assembly 30 (see FIG. 8) allows the remaining components of the petal assembly 30 (see FIG. 8) swept from the recess 17 of the body 10.

Referring now to FIG. 7, FIG. 7 is a front cross section of the body 10, consisting of a top 11, a box connection 12, inside diameter 14, upper lip 15, petal recess 17, lower lip 18, pin connection 19 and, bottom 20.

Figure 8:
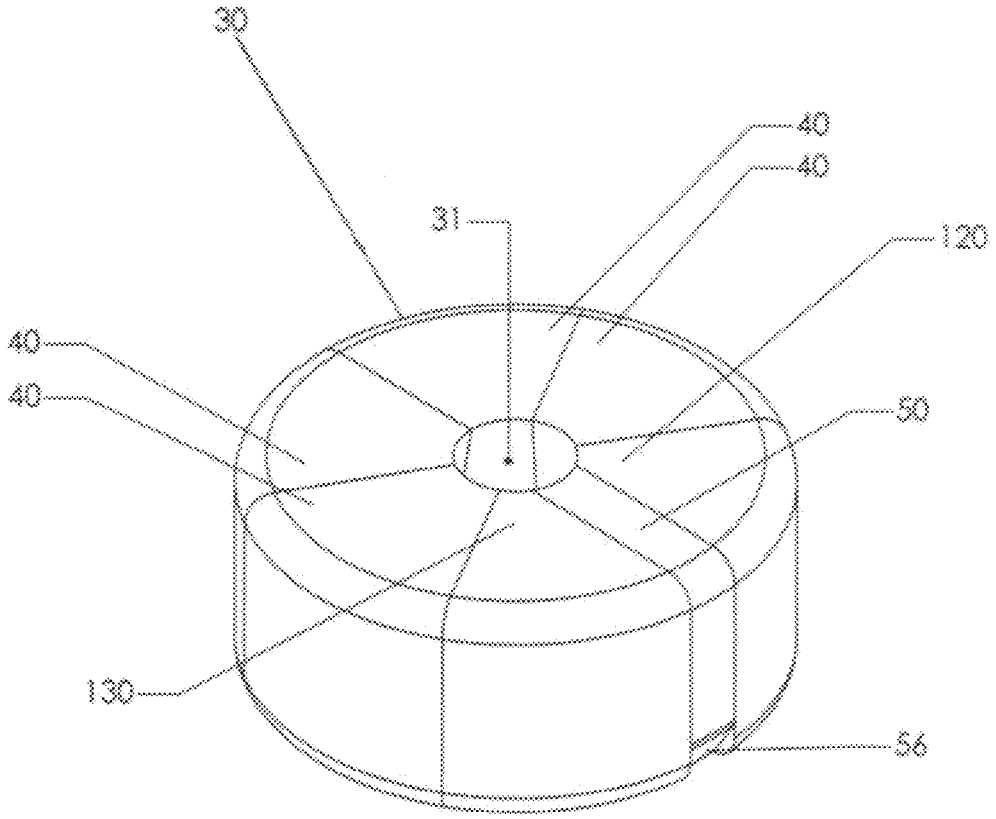
FIG. 8 is an isometric view, of the petal assembly of the internal bidirectional tubing plug.

Referring now to FIG. 8, FIG. 8, is an isometric view of the petal assembly 30, consisting of petals 40 (see FIG. 9), top petal 120 (see FIG. 10), bottom petal 130 (see FIG. 11), and keystone petal 50 (see FIG. 12), and hole in the petal assembly 31.

Figure 9:
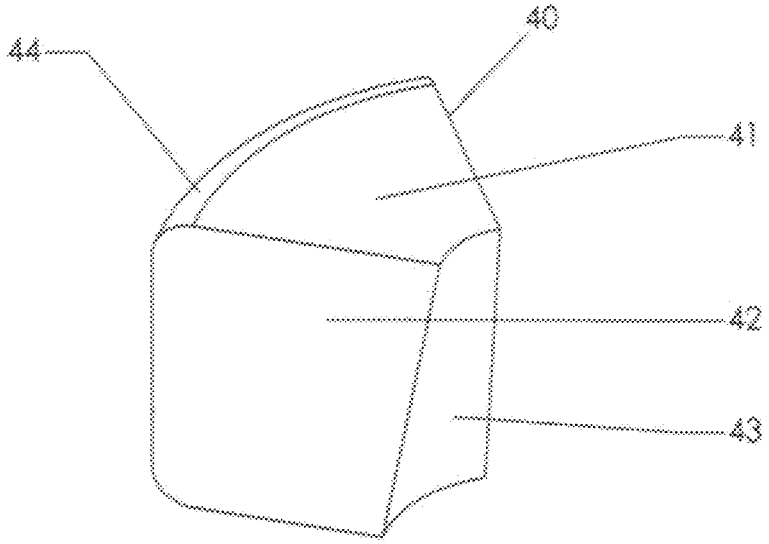
FIG. 9 is an isometric view of the petals of the internal bidirectional tubing plug.
Figure 9:
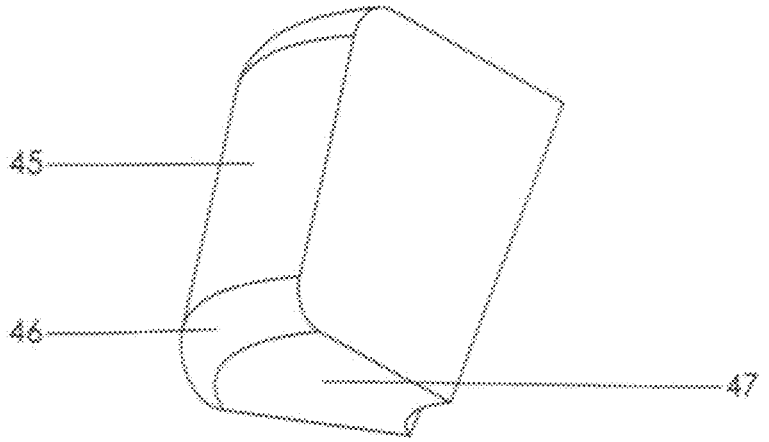

Referring now to FIG. 9, FIG. 9 is an isometric view of the petals 40. The petals are assembled into the internal bidirectional tubing plug 1 (see FIG. 1). The petals 40 are composed of a top 41, side 42, tapered conical surface 43, an upper edge 44 and in Detail A, a back 45, lower edge 46 and bottom 47.

Figure 10:
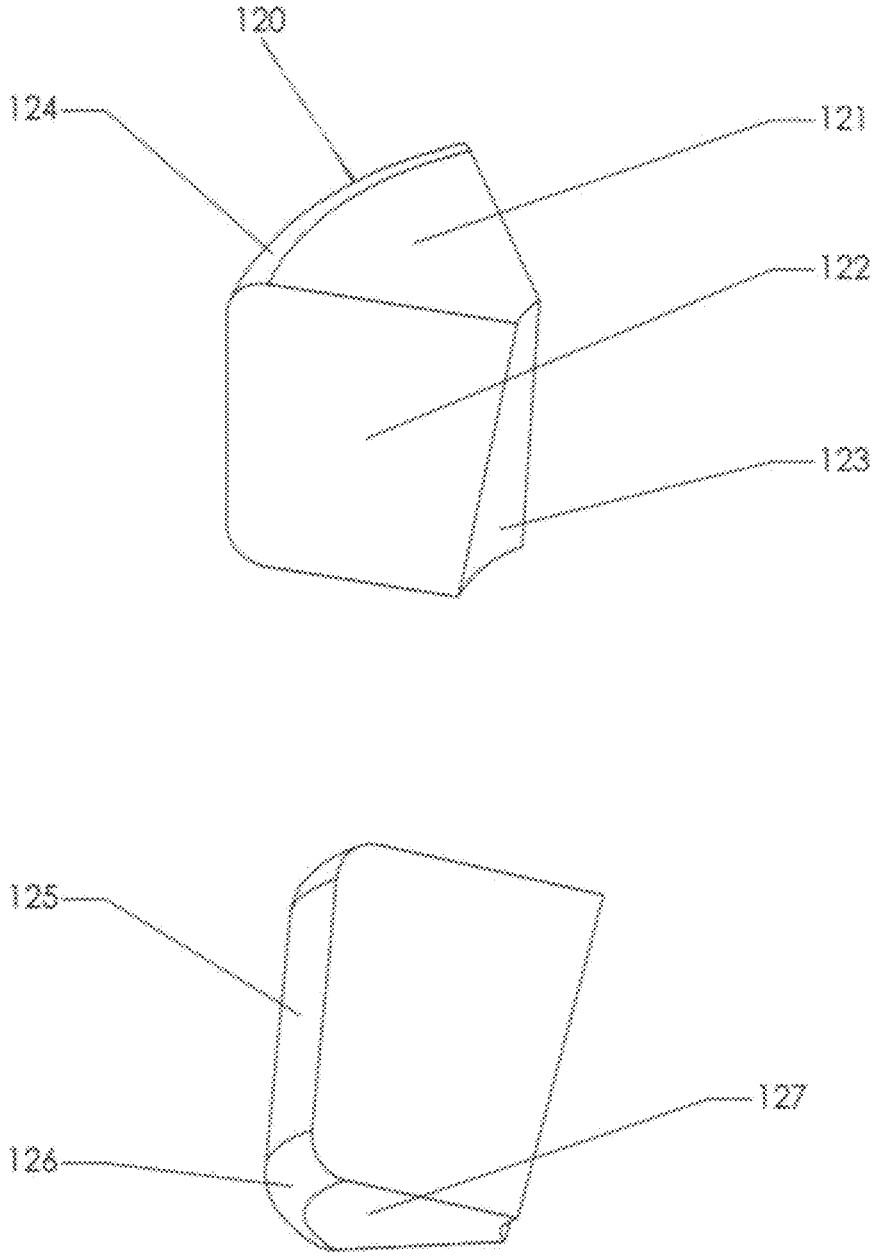
FIG. 10 is an isometric view of the top petal of the internal bidirectional tubing plug.

Referring now to FIG. 10, FIG. 10 is an isometric view of the top petals 120. The top petal is assembled into the internal bidirectional tubing plug 1 (see FIG. 1). The top petal 120 is composed of a top 121, side 122, tapered conical surface 123, upper edge 124 and in Detail A, a back 125, lower edge 126 and bottom 127.

Figure 11:
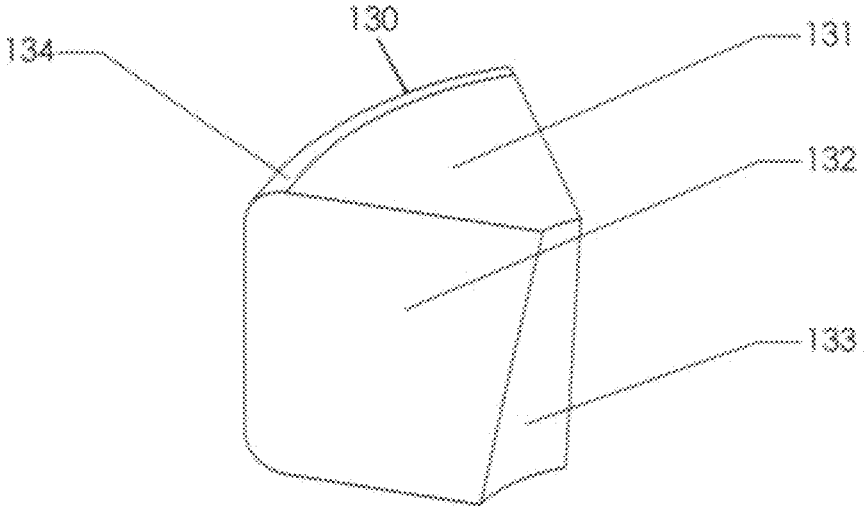
FIG. 11 is an isometric view of the bottom petal of the internal bidirectional tubing plug.
Figure 11:
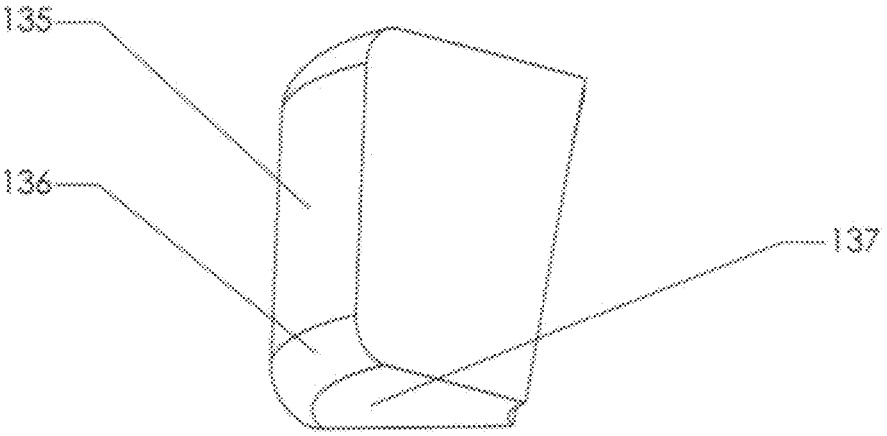

Referring now to FIG. 11, FIG. 11 is an isometric view of the bottom petals 130. The bottom petal is assembled into the internal bidirectional tubing plug 1 (see FIG. 1). The bottom petal 130 is composed of a top 131, side 132, tapered conical surface 133, upper edge 134 and in Detail A, a back 135, lower edge 136 and bottom 137.

Figure 12:
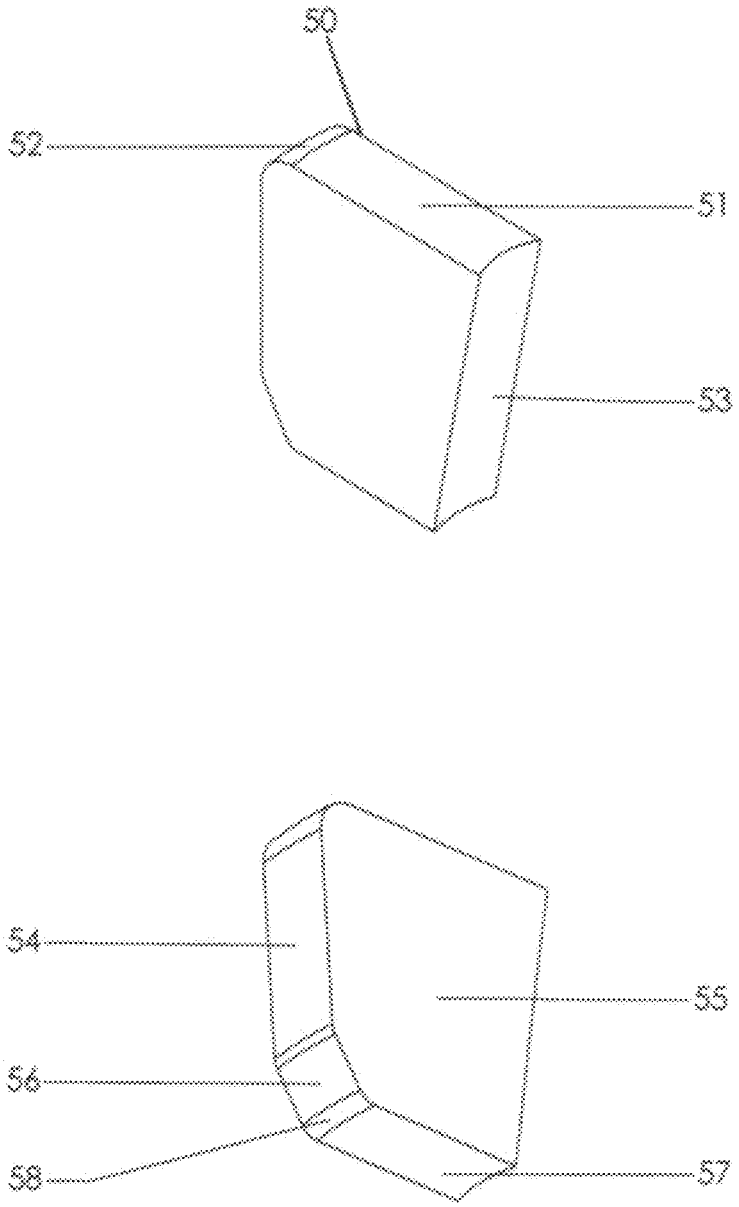
FIG. 12 is an isometric view of the keystone petal of the internal bidirectional tubing plug.

Referring now to FIG. 12, FIG. 12 is an isometric view of the keystone petal 50. The keystone petal 50 is assembled into the internal bidirectional tubing plug 1 (see FIG. 1). The keystone petal 50 is composed of a top 51, tapered conical surface 53, an upper edge 52, and in Detail A, a back 54, a bevel 56, an inner lip 58, bottom 57, and sides 55.

Figure 13:
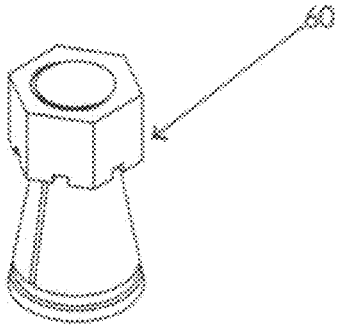
FIG. 13 is an isometric view of the cork, o-ring and nut assembly of the internal bidirectional tubing plug.
Figure 13:
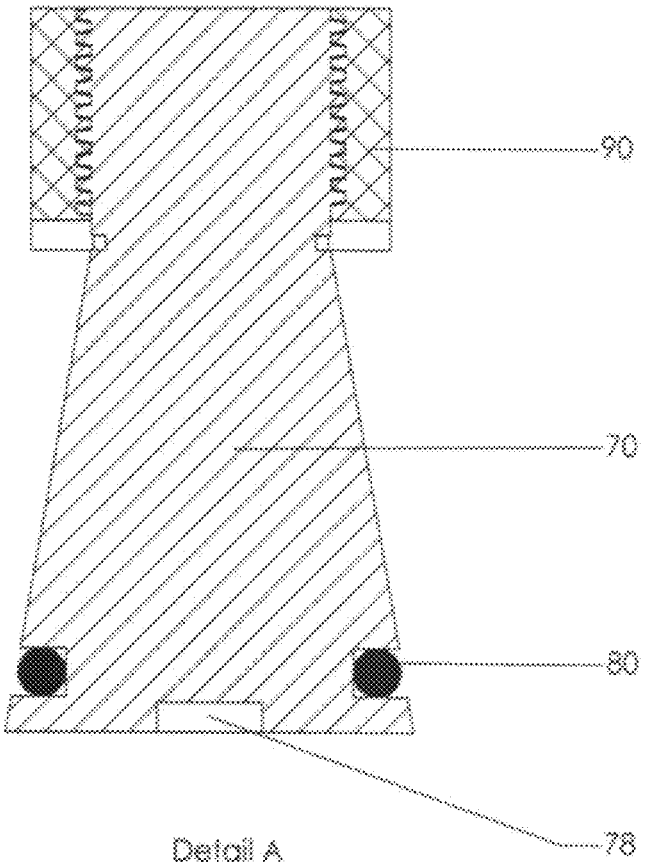

Referring now to FIG. 13, FIG. 13 is an isometric view of the cork assembly 60. In Detail A consists of a nut 90 (see FIG. 16), a cork 70 (see FIG. 14), and an O-ring 80 (see FIG. 15).

Figure 14:
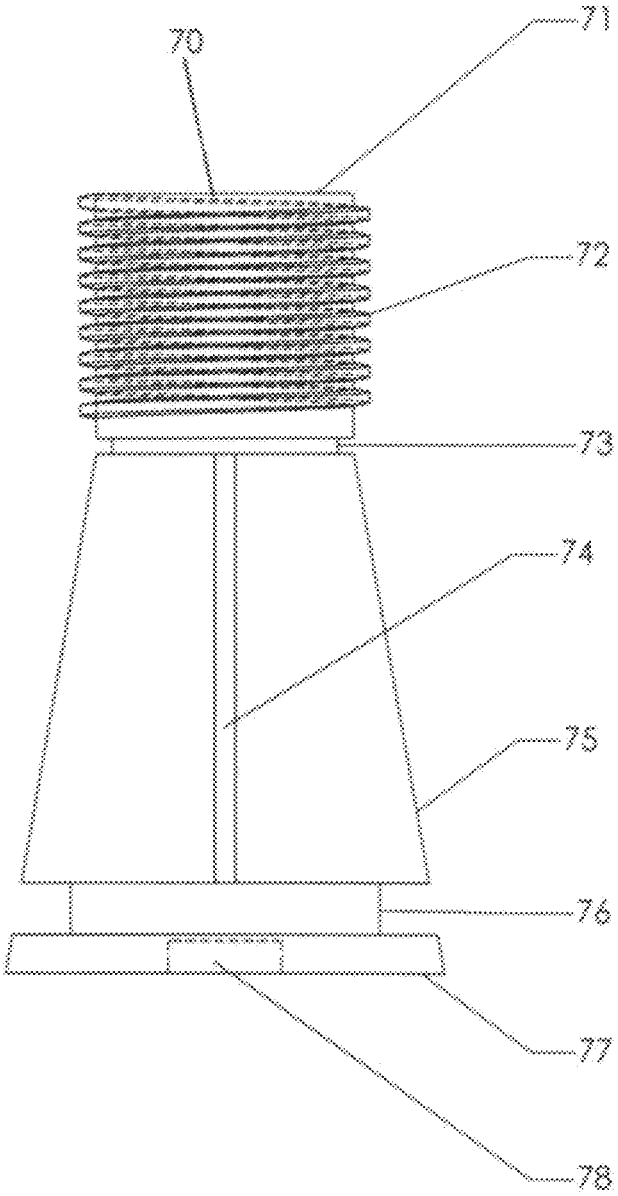
FIG. 14 is a front view of the cork, hidden lines shown, of the internal bidirectional tubing plug.

Referring now to FIG. 14, FIG. 14 is a front view of the cork 70. The cork 70 has a top 71, threads 72, a recess 73, a fluid groove 74, a tapered conical surface 75, an O-ring groove 76, a bottom 77, and a slot 78 used to screw the cork 70 into the nut 90 as described in FIG. 22 below.

Figure 15:
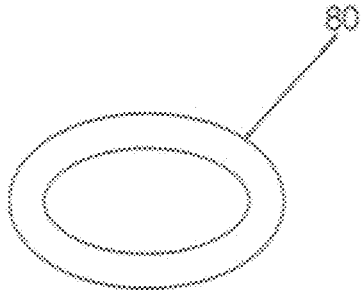
FIG. 15 is an isometric view of the o-ring of the internal bidirectional tubing plug.
Figure 15:
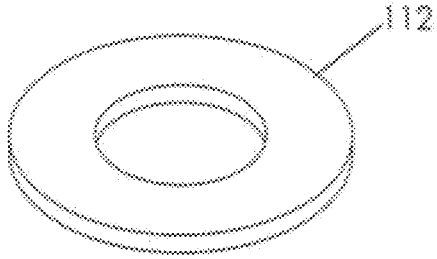
Figure 15:
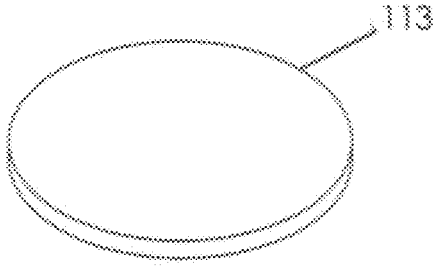

Referring now to FIG. 15, FIG. 15 is an isometric view of the O-ring 80. FIG. 15 Detail A is an isometric view of the upper piston 112. FIG. 15 Detail B is an isometric view of the lower piston 113.

Figure 16:
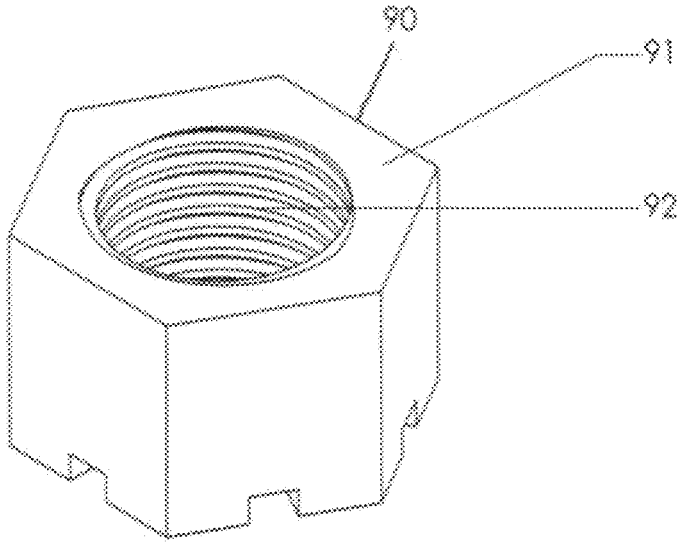
FIG. 16 is an isometric view, of the nut of the internal bidirectional tubing plug.
Figure 16:
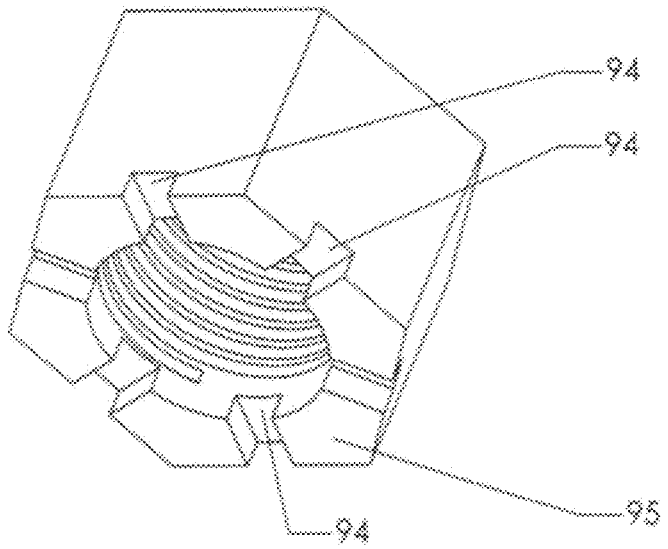

Referring now to FIG. 16, FIG. 16 is an isometric view of the nut 90. The threads 92 match the threads 72 of the cork 70 (see FIG. 14). The slots 94 (see Detail A) direct hydraulic pressure (not shown) to the fluid groove 74 of the cork 70 (see FIG. 14). The bottom 95 of the nut 90 (see Detail A) rests against the petal assembly 30 (see FIG. 8) as shown in FIG. 2 of the internal bidirectional tubing plug 1 (see FIG. 1).

Figure 17:
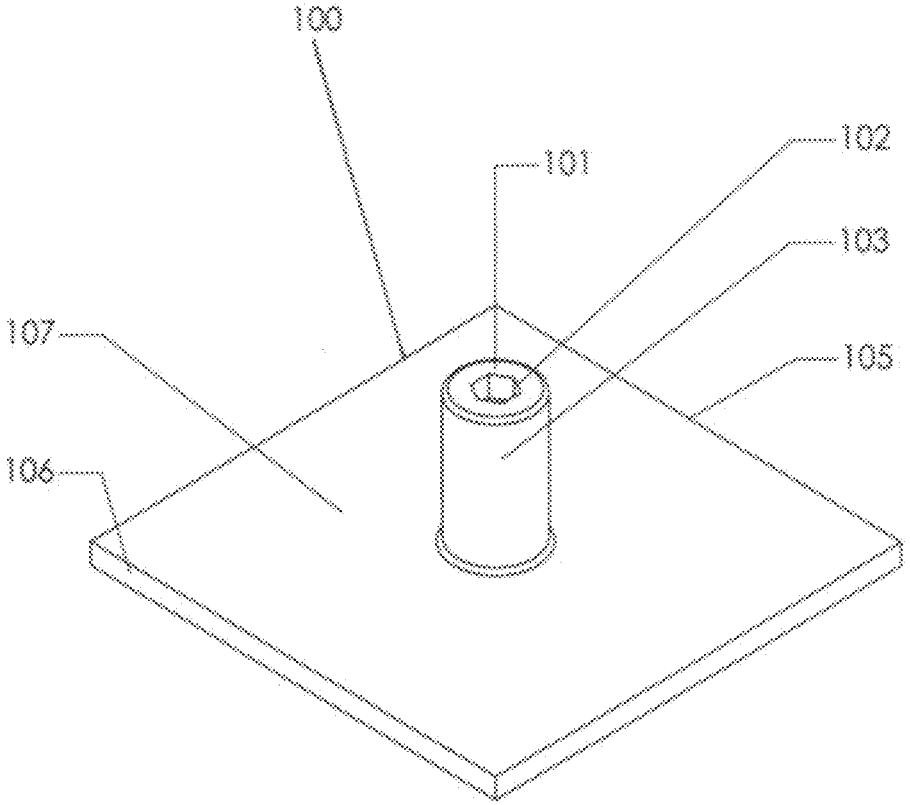
FIG. 17 is an isometric view of the assembly device of the internal bidirectional tubing plug.

Referring now to FIG. 17, FIG. 17 is an isometric view of the assembly device 100 that consists of a base plate 105, top of base 107, with sides 106, a post 103, top of post 101, that has a nut socket 102 in it that fits the nut 90 (see FIG. 16).

Figure 18:
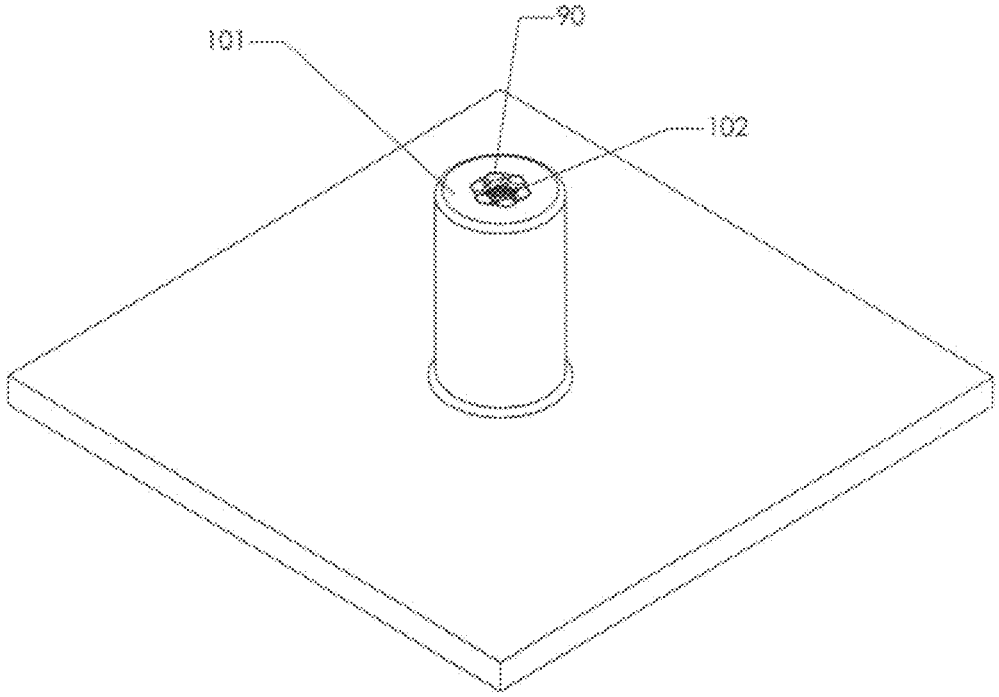
FIG. 18 is an isometric view of the assembly device, shown with a nut in place, of the internal bidirectional tubing plug.

Referring now to FIG. 18, FIG. 18 is an isometric view of the first step of the assembly method of the internal bidirectional tubing plug 1 (see FIG. 1). The first assembly step is to insert a nut 90, slots 94 up (see FIG. 16) into the nut socket 102 of the post 103 of the assembly device 100 (see FIG. 15).

Figure 19:
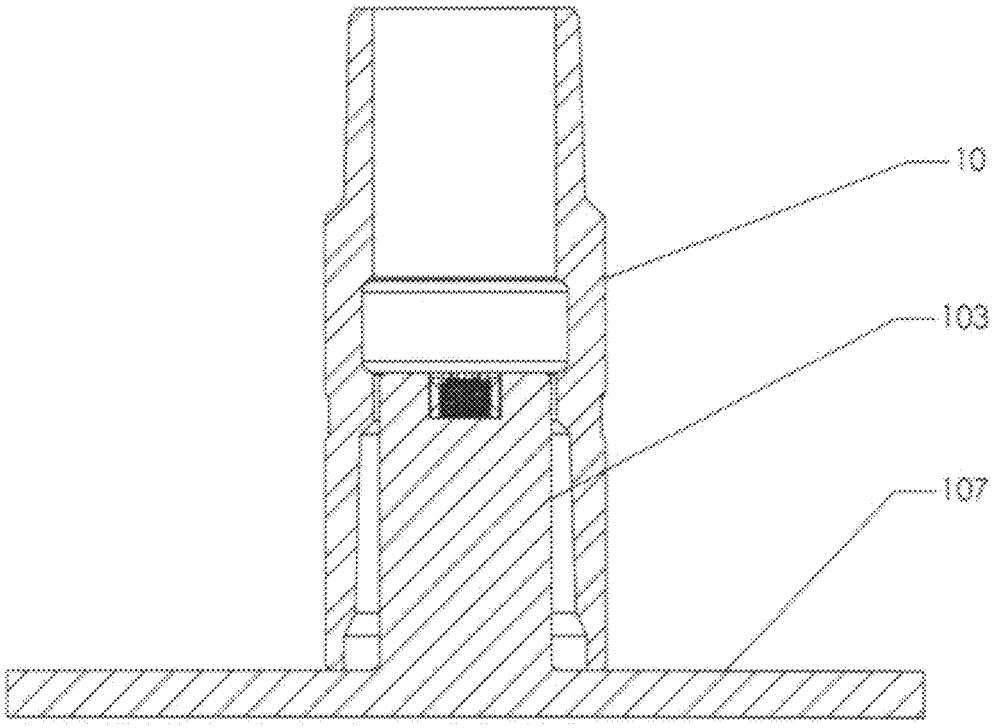
FIG. 19 is a front view of the assembly device, with a nut in place, and a body positioned over the assembly device of the internal bidirectional tubing plug.

Referring now to FIG. 1, FIG. 19 is the second step of the assembly method of the internal bidirectional tubing plug 1 (see FIG. 1). This front sectional view shows the top 11 of the body 10 (see FIG. 7) placed over the post 103 and down against the top 107 of the assembly device 100 (see FIG. 17).

Figure 20:
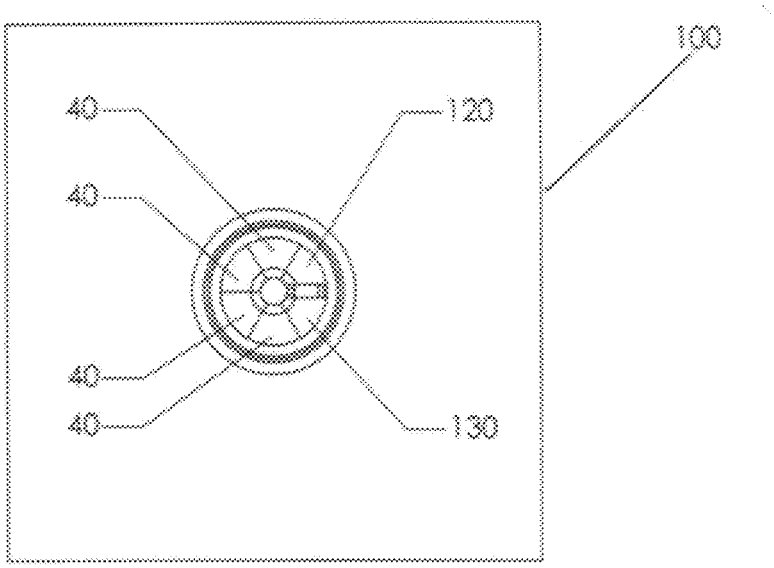
FIG. 20 is a top view of the assembly device, shown with a nut in place, a body positioned over the assembly device, and all petals in place, less the keystone petal of the internal bidirectional tubing plug.
Figure 20:
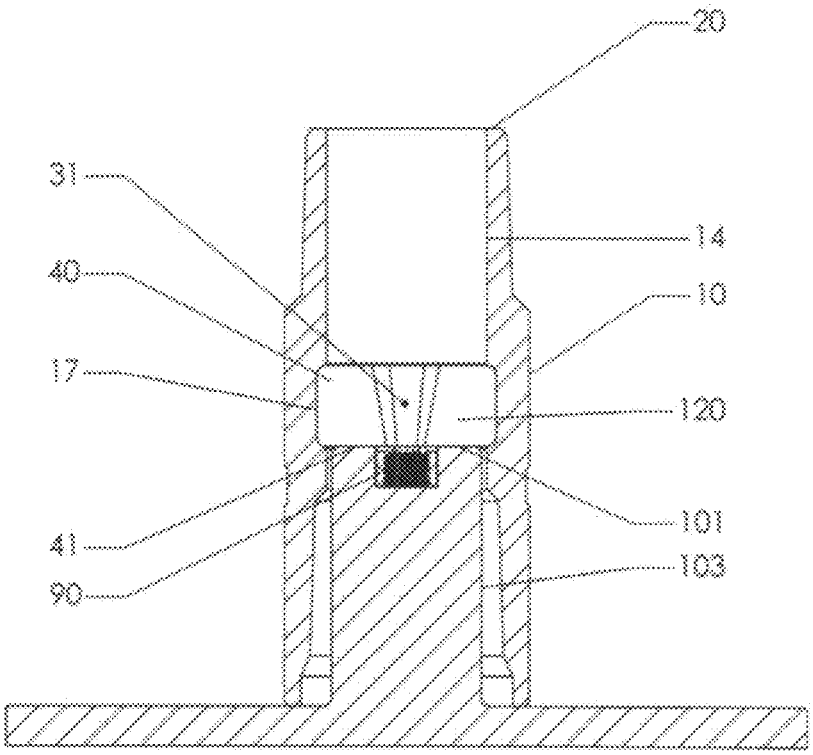

Referring now to FIG. 20, FIG. 20 is a top view of the third step of the assembly of the internal bidirectional tubing plug 1 (see FIG. 1). Detail A, is a front section view of FIG. 20. The top 41 of a petal 40 (see FIG. 9) is inserted, through the bottom 20, inside diameter 14, of the body 10 (see FIG. 7), until the top 41, of the petal 40 (see FIG. 9) is in contact with the top 101, of the post 103, of the assembly device 100 (see FIG. 17), then the petal 40 is pushed outward until its back 45 (see FIG. 9 Detail A) is in contact with the recess 17, of the body 10 (see FIG. 7), and the upper edge 44 and the lower edge 46 of the petal 40 (see FIG. 9 and Detail A), is in contact with the upper lip 15 and lower lip 18 of the Body 10 (see FIG. 7) respectively. Each petal 40 (see FIG. 9), four shown, is inserted sequentially, one after the other, and each side 42 of a petal 40 is placed in contact with the previously inserted side 42 of the prior petal 40 (see FIG. 9). After the four, as shown, petals 40 (see FIG. 9) are inserted into the body 10 (see FIG. 7), the top 121 of the top petal of the top petal (see FIG. 10), and the top of the bottom petal 130 (see FIG. 11) are inserted and adjusted as described above leaving room for the keystone petal 50 (see FIG. 10) to be inserted as described in FIG. 21 below. This third assembly step, when finished, generates a hole 31 in the petal assembly 30 (see FIG. 8).

Figure 21:
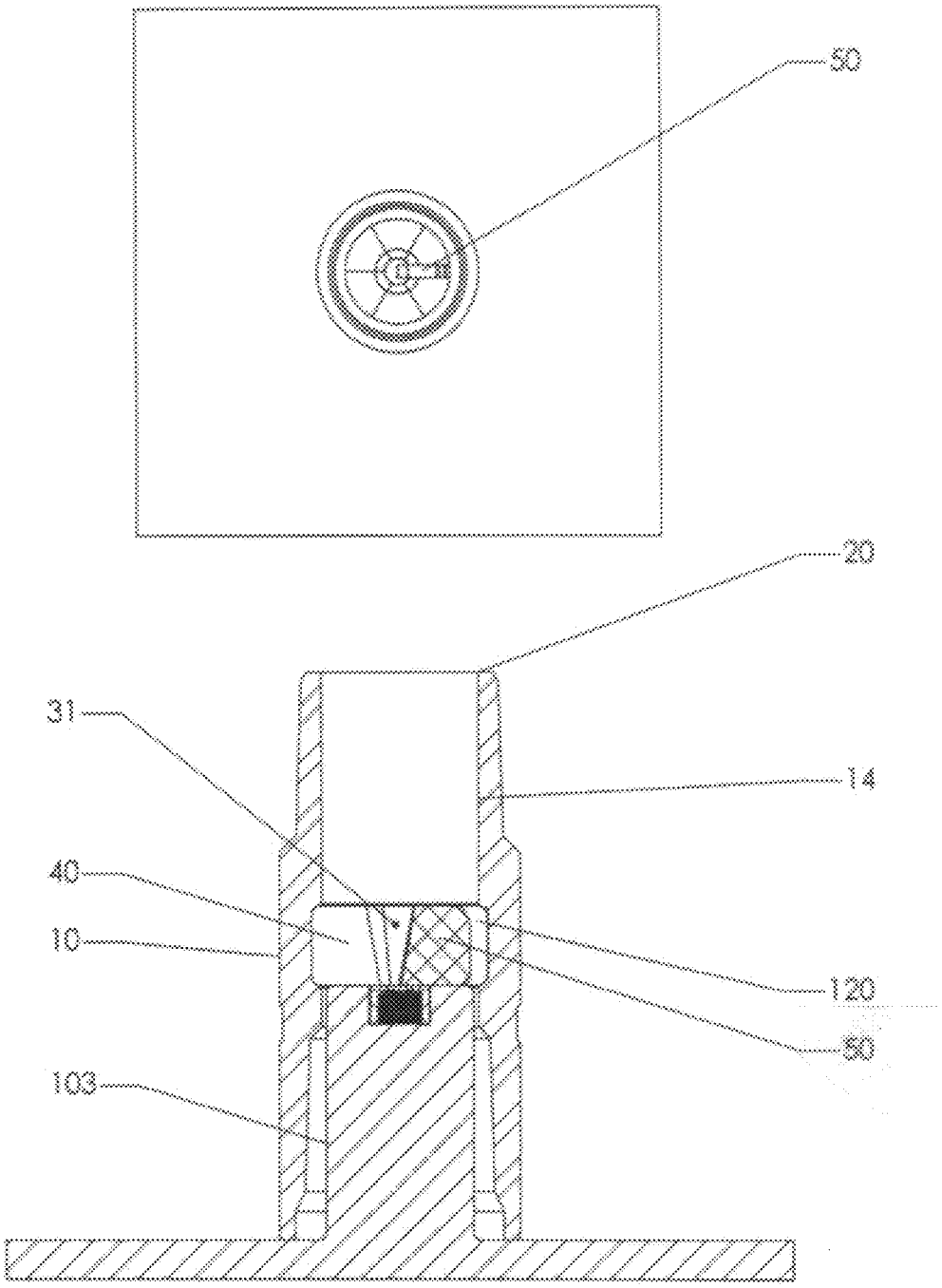
FIG. 21 is a top view of the assembly device, shown with a nut in place, a body positioned over the assembly device, all petals in place, and the keystone petal pre positioned in place of the internal bidirectional tubing plug.

Referring now to FIG. 21, FIG. 21 is a top view of the fourth step of the assembly of the internal bidirectional tubing plug 1 (see FIG. 1). See FIG. 21, Detail A. The top 51 of a keystone petal 50 (see FIG. 12) is inserted, through the bottom 20, inside diameter 14, of the body 10 (see FIG. 7), until the top 51, of the keystone petal 50 (see FIG. 12) is in contact with the top 101 of the post 103 of the assembly device 100 (see FIG. 17) which places the sides 55 of the keystone petal 50 (see FIG. 10 Detail A) in sliding contact with the side 122 of the top petal 120 (see FIG. 10), and the side 132 of the bottom petal 130 (see FIG. 11). The back 54 of the keystone petal 50 slides down the inside diameter 14 of the body 10 until the bottom 57 of the keystone petal 50 is in contact with the top 101 of the post 103 of the assembly device 100 (see FIG. 17), through the hole 31 in the petal assembly 30 (see FIG. 8). Next, and not shown in this figure, back 54 keystone petal 50 is pushed outward until the back 54 is contact with the recess 17 of the body 10 (see FIG. 7).

Figure 22:
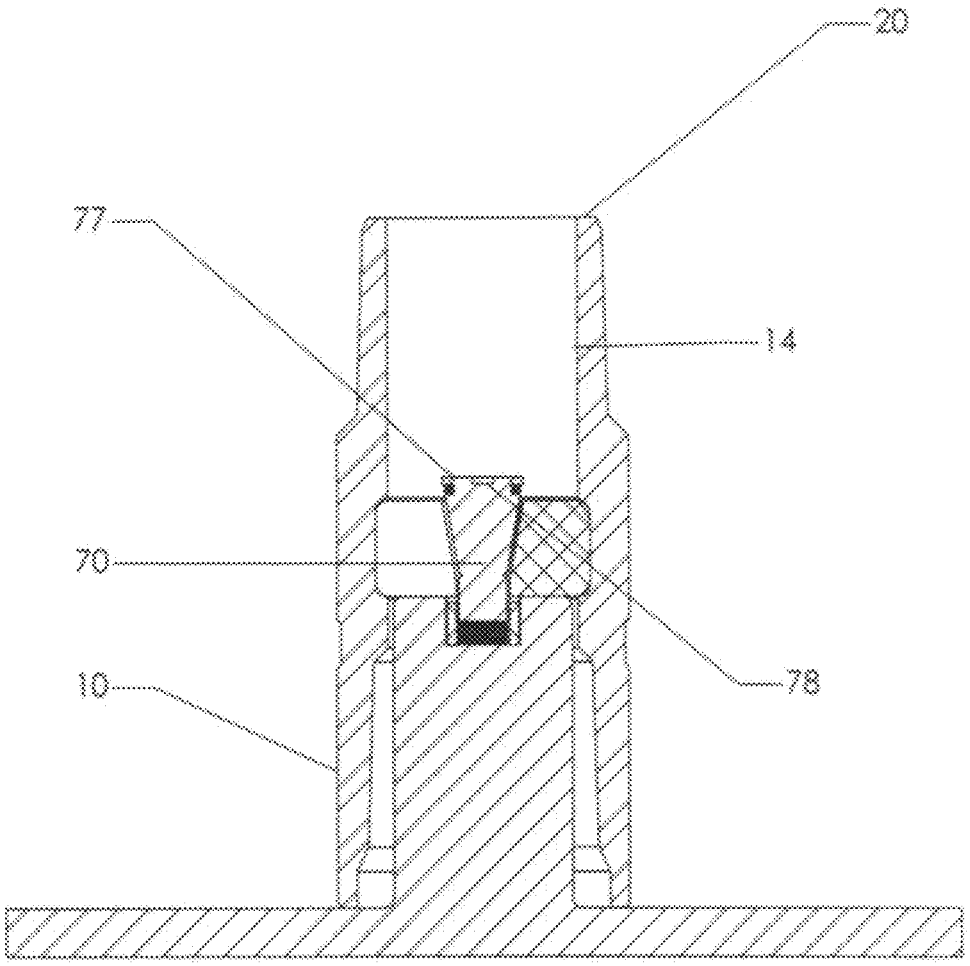
FIG. 22 is a front cross section view of the assembly device, shown with a nut in place, a body positioned over the assembly device, petals in place, and the keystone petal positioned in place in the body, and the cork partially screwed into the nut of the internal bidirectional tubing plug.

Referring now to FIG. 22, FIG. 22 is a front sectional view of the fifth step of the assembly of the internal bidirectional tubing plug 1 (see FIG. 1). The top 71 of a cork 70 (see FIG. 14) is inserted, through the bottom 20, inside diameter 14, of the body 10 (see FIG. 7), until the threads 72 of the cork 70 (see FIG. 14) engage the threads 92 of the nut 90 (see FIG. 16), the cork 70 is rotated by a screw driver device (not shown) inserted into slot 78 of the cork 70 until the bottom 77 of the cork 70 (see FIG. 12) is even (not shown) with the bottom 47 of one or more of the petals 40 (see FIG. 9).

Figure 23:
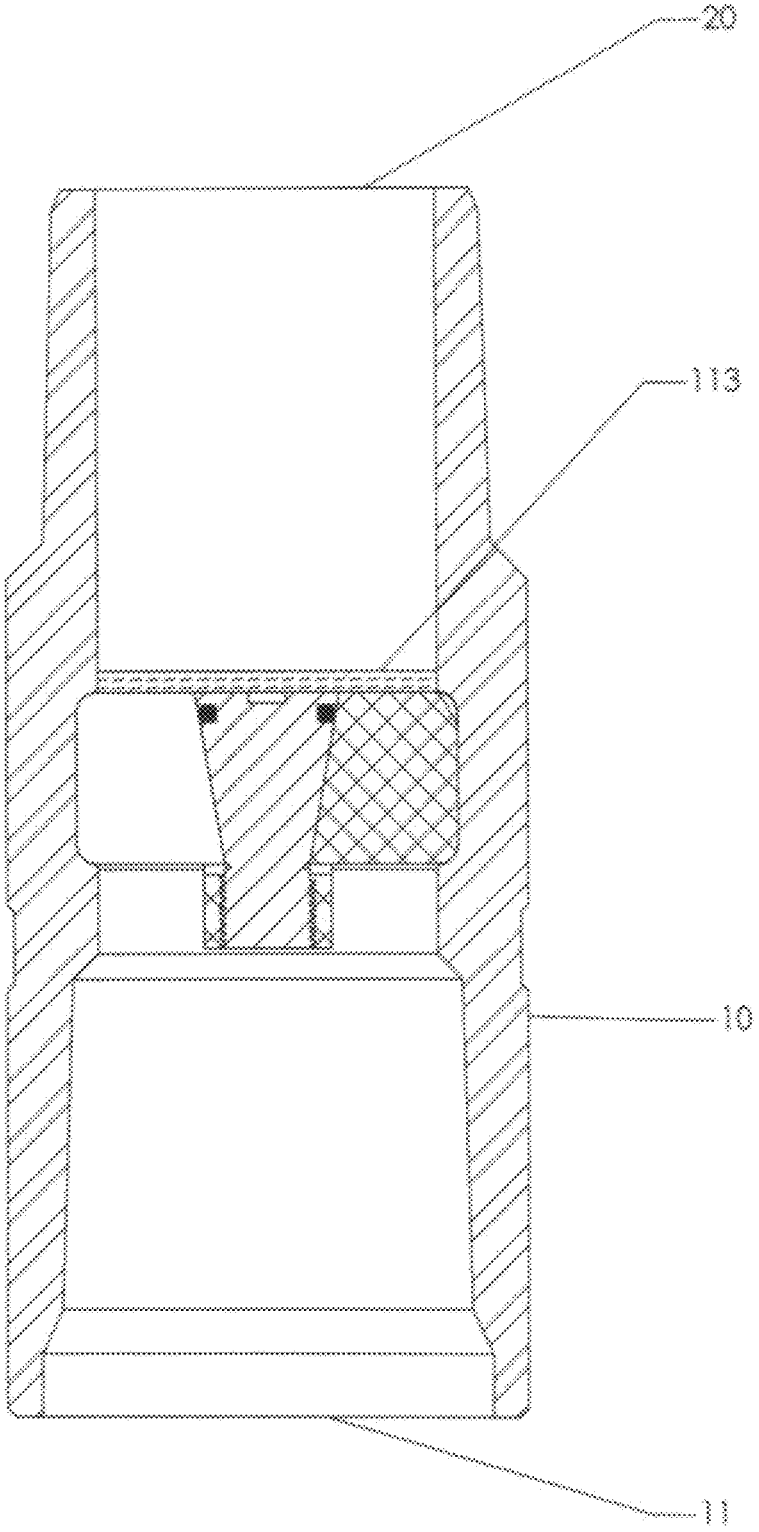
FIG. 23 is a front cross section view of the tubing cork assembled shown with a lower piston of the internal bidirectional tubing plug.

Referring now to FIG. 23, FIG. 23, a front sectional view, of the sixth step of the assembly of the internal bidirectional tubing plug 1 (see FIG. 1). The top 11 of the body 10 (see FIG. 7) is placed on a flat surface (not shown) and a lower piston 113 (see FIG. 15 Detail B), (composed of a poured RTV material or a flexible rubber like material) is attached to the bottom 47 of the petals 40 (see FIG. 9), the bottom 127 of the top petal (see FIG. 10 Detail A), the bottom 137 of the bottom petal (see FIG. 11 Detail A), the bottom 57 of the keystone petal 50 (see FIG. 12), and the bottom 77 of the cork 70 (see FIG. 14) at which time the internal bidirectional tubing plug 1 (see FIG. 1) is rotated (not shown) until the bottom 20, of the body 10, (see FIG. 10) is on a flat surface (not shown) and the upper piston 112 (not shown) (see FIG. 15 Detail A) is attached in a like manner.

Figure 24:
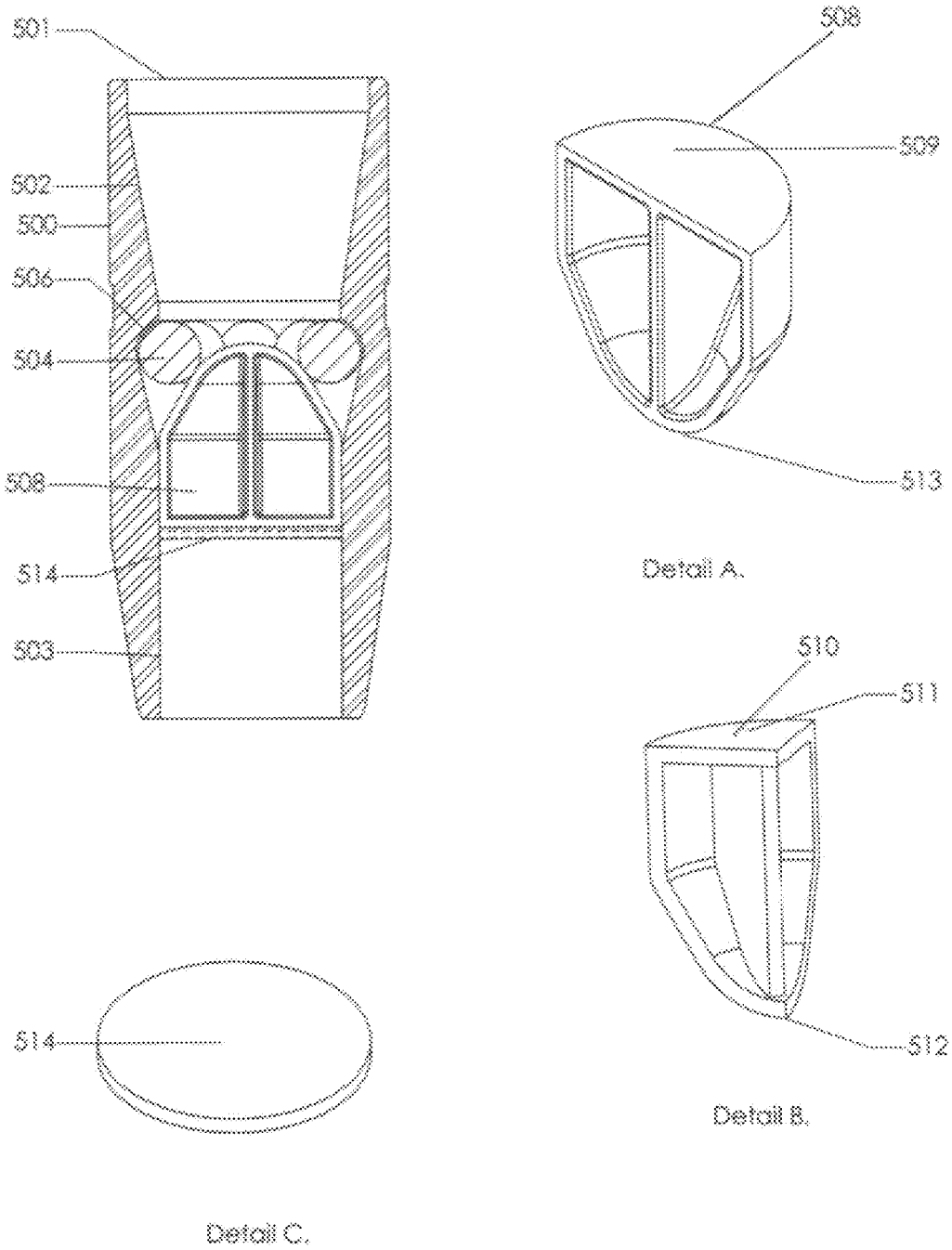
FIG. 24 is a front cross section view of an embodiment of the invention using one row of balls, an assembly of pistons, and a lower piston, of the internal bidirectional tubing plug.

Referring now to FIG. 24, FIG. 24, a front sectional view, of an embodiment of the internal bidirectional tubing plug (see FIG. 1). This embodiment is for use in wells; that have a slight flowing gas condition, which is unsafe to run open ended tubing in, wells that when shut in do not build up enough pressure to require a snubbing unit to run the tubing with a blanking plug in the snubbed tubing, wells that operators do not want to kill with a well fluid to run the tubing, as known in the art. Gas pressure (not shown) acting below the piston 514 (see FIG. 24) pushes upward on the cross sectional area (not shown) of the half-pistons 508 (see Detail A) or the cross sectional area (not shown) of the quarter pistons 510 (see Detail B) when used, transferring the generated force of the gas (not shown) to a plurality of balls 504, which transfer the force (not shown) in the balls to the groove 506 of the body 500, preventing any upward flow of liquids of gases through this embodiment. When the well is nippled up (not shown and as known in the art) fluids or gages (not shown) may be directed down the tubing (not shown) to sent the parts of this embodiment out the end of the tubing string (not shown) opening the well to production (not shown).

Figure 25:
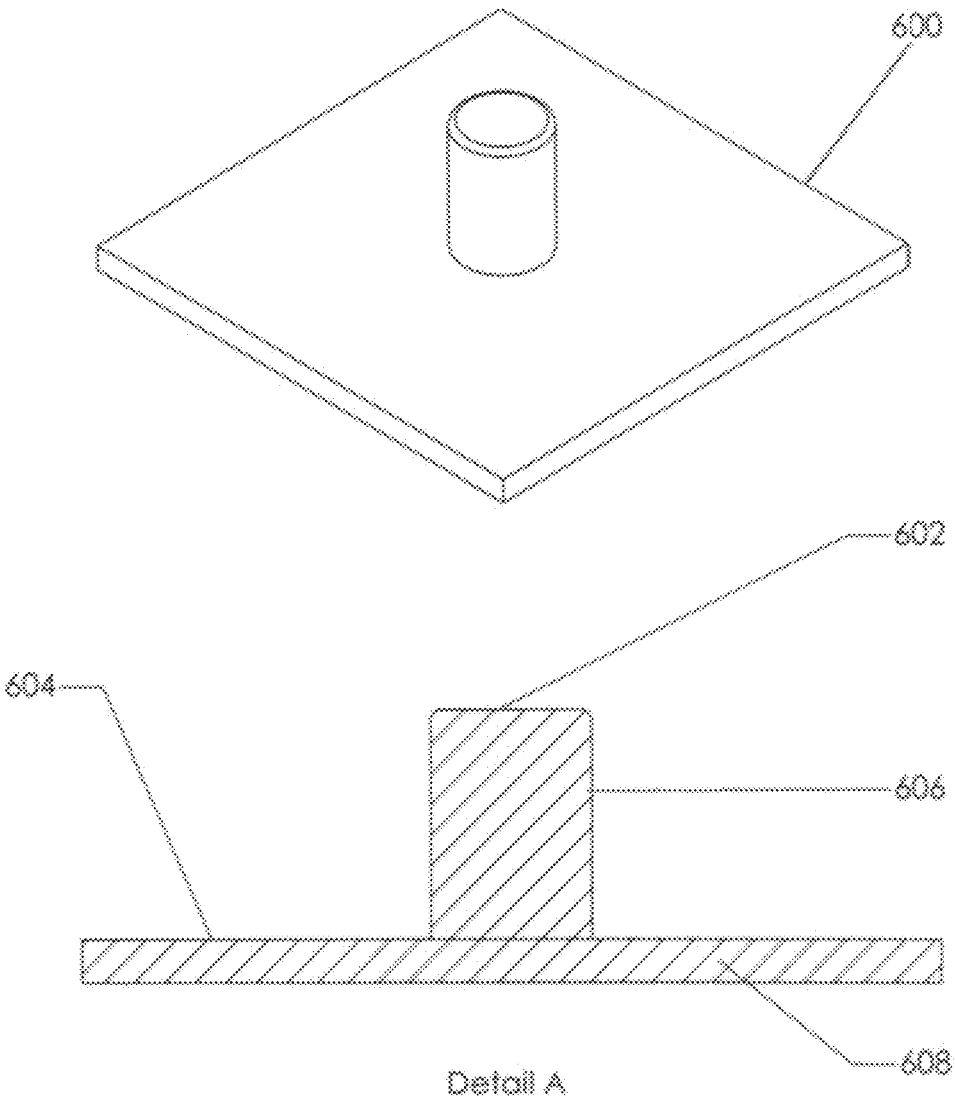
FIG. 25 is an isometric view of an assembly device for the embodiment shown in FIG. 24 of the internal bidirectional tubing plug.

Referring now to FIG. 25, FIG. 25 is an isometric view of assembly device 600. FIG. 25, Detail A, is a front sectional view of the assembly device 600 used to assemble an embodiment as described in FIG. 24.

Figure 26:
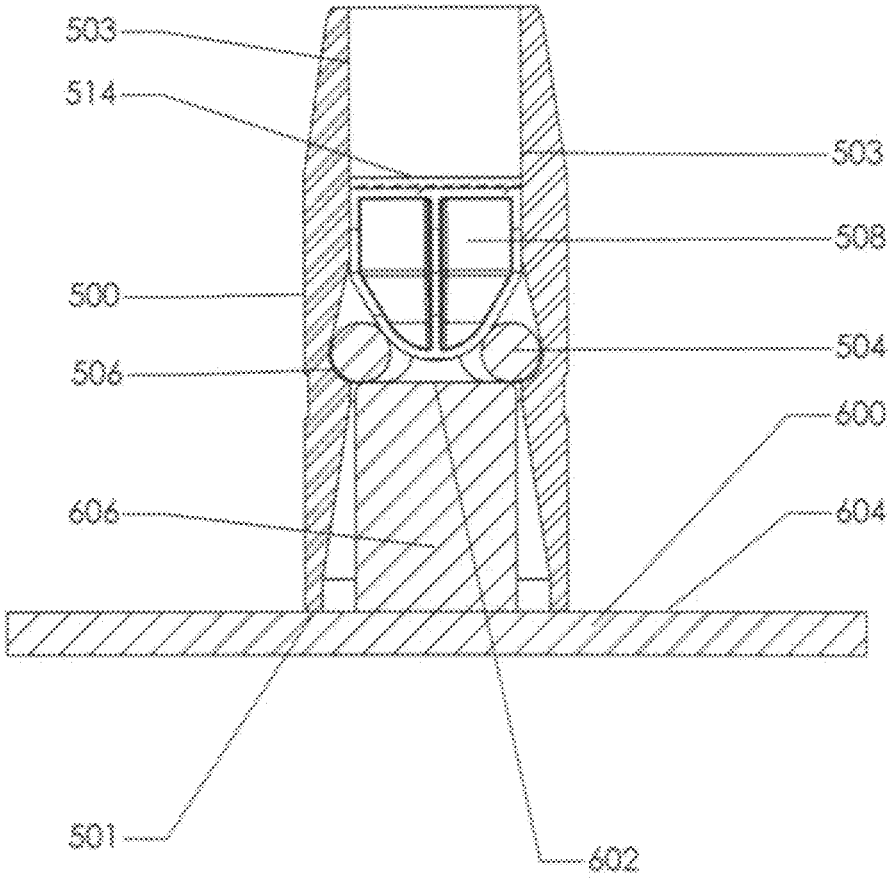
FIG. 26 is a front cross sectional view of the embodiment, shown in FIG. 24, as it is assembled, of the internal bidirectional tubing plug.

Referring now to FIG. 26, FIG. 26 is a front cross sectional view of an assembly device 600 (see FIG. 22) and the embodiment as shown in FIG. 24. The method of assembly is to place the assembly device 600 on a flat surface (not shown) and place the top 501 of body 500 (see FIG. 24) over the center (not shown) of the post 606 until the top 501 of body 500 (see FIG. 24) is in contact with the top 604 of the assembly device (see FIG. 23). Next, a pre determined number and size of balls 504 are placed on top 602 of the post 606 of the assembly device 600 (see FIG. 25). Next, two half-pistons 508, or four quarter-pistons 510 (see FIG. 24 Detail A and B) are placed nose 513 or 510 (See FIG. 24 Detail A or B) down in the pin 503 of the body 500 and rotated (not shown) until all of the balls 504 are equally distributed in the groove 506 of the body 500. A piston 514 (a rubber like material) is affixed to the bottom 509 of the half-piston or bottom 511 of the quarter-piston (see FIG. 24 details A and B respectively).

Figure 27:
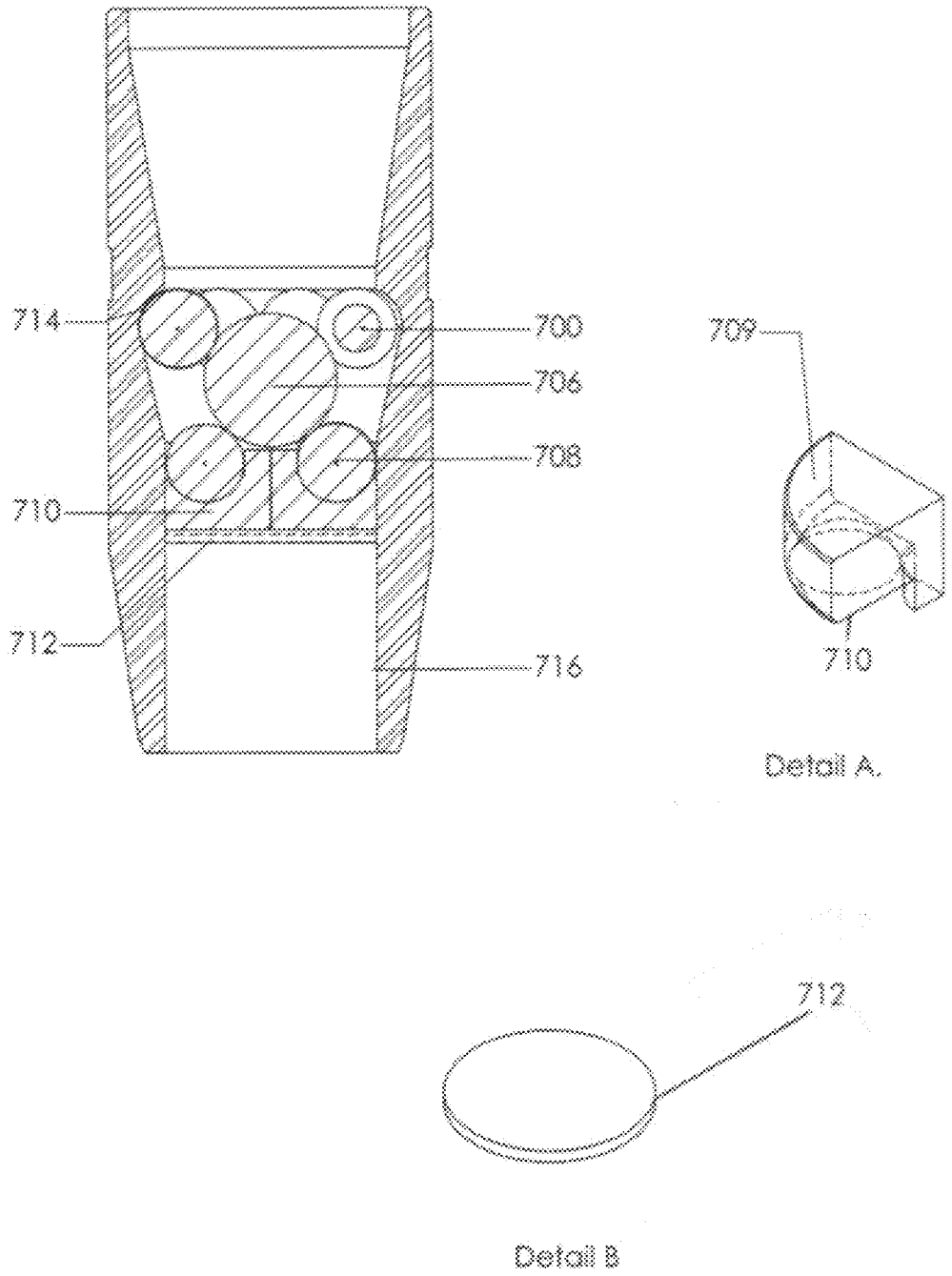
FIG. 27 is an embodiment of the internal bidirectional tubing plug using three rows of balls and a four quarter pistons of the internal bidirectional tubing plug FIG. 27 Detail A is an isometric view of a one-quarter piston of an embodiment of the internal bidirectional tubing plug that uses three rows of balls.

Referring now to FIG. 27, FIG. 27 is a front cross sectional view of a second embodiment of an internal bidirectional tubing plug (see FIG. 1). Referring now FIG. 24, FIG. 27 is unlike in its construction and use, only in that it has a center ball 706 and a second row of balls 708 and quarter pistons 710 (Detail A). A piston detail B is placed below the quarter pistons 710 on their bottom 709 (Detail B).

It is apparent to those skilled in the art that the size and shape of the body and components of the internal bidirectional tubing plug are variable and only need to be sized and shaped to allow the invention to perform as described in well conduits, in any direction, in any cross sectional area, with any fluid of gas at any temperature.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A method of releasing components of a well closure apparatus comprising:

a) applying hydraulic pressure to a cork of a well closure apparatus in a direction to release the cork from a nut that restrains the cork and holds the cork within the well closure apparatus, b) generating a releasing force on the cork by the hydraulic pressure acting on the cork such that the cork is parted into two pieces at a predetermined hydraulic pressure and a lower piece of the cork is released from the well closure apparatus, c) allowing fluid flow through an opening vacated by the lower piece of the cork to generate a differential pressure across petals and keystone that were originally held in place by the intact cork within a hollow interior passage of the well closure apparatus, d) releasing the keystone from the passage by the generated differential pressure acting on the keystone and the petals, and e) removing the petals from the passage of the body by the resulting flow of well fluids through an opening in the petals vacated by the keystone and the lower piece of the cork.

2. The method of releasing components of the well closure apparatus according to claim 1 further comprising:

f) removing an upper piece of the cork and an attached nut from the passage of the body by the resulting flow of well fluids through an opening in the passage vacated by the petals, keystone, and the lower piece of the cork.

3. The method of releasing components of the well closure apparatus according to claim 2 further comprising:

g) removing an upper piston from the passage of the body by the resulting flow of well fluids through an opening in the passage vacated by the petals, keystone, and the cork.

4. The method of releasing components of the well closure apparatus according to claim 3 wherein the step of generating the releasing force on the cork further comprises:

a lower piston is released from the well closure apparatus with the lower piece of the cork.

* * * * *